US010624819B2

(12) United States Patent
Prosise et al.

(10) Patent No.: US 10,624,819 B2
(45) Date of Patent: Apr. 21, 2020

(54) BEVERAGE CONTAINER GRIP SUPPORT

(71) Applicant: Be Known Manufacturing LLC, Austin, TX (US)

(72) Inventors: Roy Paul Prosise, Cedar Park, TX (US); Daniel Caputo, Cedar Park, TX (US); Benjamin Derek Litteral, Cedar Park, TX (US)

(73) Assignee: BeKnown Manufacturing LLC, Cedar Park, TX (US)

( * ) Notice: Subject to any disclaimer, the term of this patent is extended or adjusted under 35 U.S.C. 154(b) by 163 days.

(21) Appl. No.: 15/419,521

(22) Filed: Jan. 30, 2017

(65) Prior Publication Data

US 2017/0215615 A1 Aug. 3, 2017

Related U.S. Application Data

(60) Provisional application No. 62/288,328, filed on Jan. 28, 2016.

(51) Int. Cl.

| | |
|---|---|
| ***A63H 3/28*** | (2006.01) |
| ***A61J 17/02*** | (2006.01) |
| ***A61J 9/06*** | (2006.01) |
| ***A63H 3/00*** | (2006.01) |

(52) U.S. Cl.

CPC ..... *A61J 17/02* (2013.01); *A61J 9/0607* (2015.05); *A61J 9/0623* (2015.05); *A61J 9/0638* (2015.05); *A61J 9/0669* (2015.05); *A63H 3/003* (2013.01)

(58) Field of Classification Search

CPC ..... A61J 17/02; A61J 9/0607; A61J 9/0623; A61J 9/0638; A61J 9/0669; A63H 3/003

USPC ..... 215/11.1; 248/102, 103, 105; 220/737

See application file for complete search history.

(56) References Cited

U.S. PATENT DOCUMENTS

| | | | | |
|---|---|---|---|---|
| 4,309,008 | A | 1/1982 | Sirks | |
| 4,943,017 | A * | 7/1990 | Ennis | A61J 9/0623 215/11.1 |
| 5,794,898 | A | 8/1998 | Bradley et al. | |
| 6,827,317 | B1 * | 12/2004 | Maki Risaliti | A63H 3/003 248/102 |
| 6,915,991 | B1 | 7/2005 | Shomer et al. | |
| 2013/0324006 | A1 * | 12/2013 | Marshall | A63H 3/28 446/297 |
| 2015/0069096 | A1 * | 3/2015 | Kampas | A45F 5/00 224/148.6 |

* cited by examiner

*Primary Examiner* — Andrew T Kirsch
*Assistant Examiner* — Elizabeth J Volz
(74) *Attorney, Agent, or Firm* — Lee & Hayes, P.C.

(57) ABSTRACT

A beverage container holder has a frame with a ring having an aperture for supporting and retaining a beverage container. The aperture can adapt to different sizes of beverage containers. The frame also has appendages extending therefrom. Some of the appendages are handles and some of the appendages are support stabilizers. The beverage container holder resembles an animal, and the appendages resemble ears and legs of the animal.

21 Claims, 37 Drawing Sheets

BEVERAGE CONTAINER GRIP SUPPORT

RELATED APPLICATION

This patent application claims priority to and the benefit of U.S. Provisional Patent Application No. 62/288,328, filed on Jan. 28, 2016, which is incorporated herein by reference in its entirety.

BACKGROUND

Field of Disclosure

The present invention relates in general to a container grip support that can be used for as a method and apparatus for supporting various drinking containers, such as a bottle, can, cup, jar thermos, baby bottle or sippy cup, in a manner that allows a baby or toddler to self-feed or drink from the container in the natural nursing, feeding and drinking posture.

Description of the Prior Art

The height and angle of a drinking container is important to allow a proper flow of fluid, liquid food or beverage into a child's mouth for consumption. There are various devices that serve as bottle holders, but none that apply as a universal grip unique to multiple drinking containers.

FIGS. 19A and 19B are from the U.S. Pat. No. 6,915,991 to Shomer et al for "Bottle retainer for a baby." That reference describes a manually bendable strip made from a stainless steel ribbon within a vinyl sheath. The sheath with the stainless steel ribbon within a vinyl sheath. The sheath with the stainless steel ribbon are encased within a casing made from a soft fabric. A central region of the strip is a bottle holder in the shape of an open ended ring. Ends of the ring form tongs that can fit onto a baby's torso. A fabric strip is tied about a junction formed by the bottle holder and the tongs.

Prior art devices for holding a baby bottle in a particular orientation. FIGS. 20A and 20B are from U.S. Pat. No. 5,794,898 to Bradley et al for "Nursing bottle propping apparatus." That reference describes an apparatus for propping a nursing bottle so that an infant child can drink from the bottle includes a bottle holding portion; and an apparatus mounting portion including at least two mutually diverging first flexible members for abutting the sides of the torso of an infant child to removably secure the apparatus to the child with friction engagement. The first flexible members may each include a skeleton segment of ductile material for bending by hand to conform to and fit against the waist of an individual child. The first flexible members alternatively each include a skeleton segment of resilient material having elastic memory and pre-shaped to lightly resiliently grip the front and sides of the infant waist. The first flexible members may be at least partly covered with high friction material. The high friction material may be non-toxic rubber tubing. The bottle holding portion may include at least two mutually diverging second flexible members for abutting the sides of the nursing bottle to removably secure the nursing bottle in the apparatus. The apparatus may additionally include a ductile and flexible connecting link interconnecting the bottle holding portion and the apparatus mounting portion, for positioning the nursing bottle holding portion, and thereby positioning the bottle, relative to the mouth of the child.

FIG. 21 is from U.S. Pat. No. 4,309,008 to Sirks for "baby bottle holder." That reference describes a baby feeder having front and rear plate members and a leaf member configured for interconnecting the other two adjacent the midpoint thereof for forming an easel, the front plate member having a pocket in the upper edge thereof configured for receiving a baby bottle. Each of the front and rear plate members and leaf member are provided with the apertures aligned and configured for receiving a single strand of an elastic member which is interlaced through the apertures to provide a hingeable connection between the leaf member and the front and rear plate members, the elastic member also forming a harness for retaining a baby bottle holder in a pocket in a baby feeding position. There is also provided beads at the front and rear of said harness for adjusting tension to accommodate different size lengths and widths of said bottle.

SUMMARY OF EMBODIMENTS

The present invention relates in general to a container grip support that can be used for as a method and apparatus for supporting various drinking containers, bottle, can, cup, jar thermos, baby bottles or sippy cups in a manner that allows a baby or toddler to self-feed or drink from the container in the natural nursing, feeding and drinking posture.

Embodiments of an apparatus for a universal container grip and support are disclosed. This container grip support and grip apparatus will be portable, ergonomic, light-weight, BPA-free, dishwasher safe, easy to use, easy to assemble and easy to manufacture. All materials in contact with the fluid of the container may be food-safe for humans. The components may be manufactured with plastic injection molding or blow molding, and plastic and/or metal over-molding processes. The foregoing and other objects and advantages of these embodiments will be apparent to those of ordinary skill in the art in view of the following brief description, taken in conjunction with the accompanying Figures in separate document.

In one embodiment of the current invention, a substantially planar support frame is provided. The support frame has a bottom portion and top portion. The top portion is not connected to allow for separation on both sides of the top portion. There are angled container grippers that resemble clothes pins when each side of the frame is pulled in opposite directions. The angle of said container grips are slightly obtuse to accept bottles of various sizes, however the angle of each gripper could still be effective at smaller angles if a smaller diameter container is the intended use. In one example, the elected bottle gripper is molded in a closed position to provide the necessary pre-load to hold a 2.50"-3.30" diameter container (bottle or can, etc.). Although the embodiments are described for use with baby bottles and variations in bottle diameters, this apparatus can be used for other applications for other types of containers.

In another embodiment, an arched gripper may include both gripper sections as straight sections. In one example, the gripper sections may be formed at 95° for 2.25" diameter, but this same design at 110° allows for up to 3.30" diameter container. In another example, the bottom portion is bent outward to provide more surface area when in contact with the baby's chest. The bent loop at the base of the embodiment can rest on a baby's chest for balance and weight distribution. There are bumps and humps at the transition of the top and bottle portions to for ergonomic purposes that act like stoppers for additional grip assistance, namely, the grab and hold handle gripper areas. The container grip may be made of many plastics. Some design concepts may be manufactured white polypropylene pre-shot with a colored TPE over mold with a tacky consistency.

The gripper designs may be molded in a closed position for pre-load or open position for larger diameter containers.

BRIEF DESCRIPTION OF EMBODIMENTS

The following section gives a brief description of the application of the apparatus.

1. Insert a container, such as a sippy cup, into the grip arm, sleeve, ring, collar, etc.
2. Gripper area will stretch or expand to accommodate container diameter
3. Identify if container weight has been distributed evenly
4. Place container with container grip on baby's chest
5. Allow baby to grip both sides of the handles in the designated areas
6. Allow baby to tilt container towards mouth in order to self-feed or child to consume fluids from container
7. Remove container from grip when container is empty
8. Store container grip for later use Various examples of design concepts for the container grip invention are as follows:

Animal Character bottle gripper and teether design variations, Arched & Bent Gripper Combination Design Concept, Bent Gripper concept variations (4), Planar Gripper concept variations (2), Steering Wheel design variations (3), Oval design variations (2), Twisted Gripper design concept, Sleeve/Ear Gripper concept.

Figure 21:
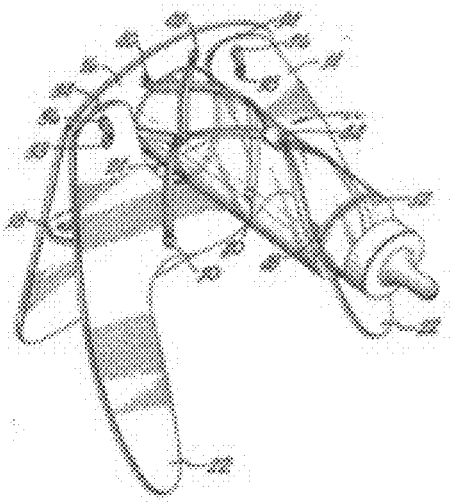
FIG 21 PRIOR ART

FIG. 21 is an isometric view drawing of a conventional design from U.S. Pat. No. 4,309,008 to Sirks for "baby bottle holder."

LIST OF ELEMENTS

The following list of elements is provided for convenience in reviewing FIGS. 1-18.

Bottle/container gripper, teether and holding device variations 100, 101, 102, 103, 104, 105, 106, 107, 108, 109, 200, 201, 202, 203, 204, 205
holding areas for hands and fingers 110
baby teething areas 111
holding bumps 112
holding humps 113
bottle/container gripper area 120
gripper pads 121
holding arm lower 122
holding arm upper 123
holder base/chest stand 130
teething areas 131
holder support frame 140
rubber frame overmold 141
wire frame 142
inner plastic frame 143
gripper angle 150
gripper distance 160
frame and gripper thickness 170

DETAILED DESCRIPTION

The various embodiments illustrated in the drawings demonstrate different perspectives, cross-sectional view and configurations of the apparatus, the components that comprise the apparatus and/or visual aids of process to manufacture.

Drawings with bottles are intended to demonstrate the relationship, assembly, mechanics and orientation between the container grip apparatus and the container itself. The apparatus utilizes dishwasher-safe, BPA free, FDA approved, high-heat capable plastic and rubber. The teether design variations and teething areas do not allow for mold to grow in the device.

FIG. 1 shows the first embodiment example of the bottle gripper and baby teether, 100, being used as a self-feeding tool for the baby to use while lying on its back. In FIG. 1, the elected design "animal character gripper" is shown however this concept can be interchanged for the sample applications of self-nursing, drinking and teething with the other design concepts shown in the related artwork.

FIGS. 1A-I and 2A-G shows embodiments of an animal container grip design. The entire device, embodiment 100, may be comprised of three major components: the holding area for hands, element 110, the container gripper area, element 120, and the base support for resting the device on a baby's chest, element 130. Two variations of this design example for the container grip are shown as an elephant character in FIGS. 1A-I and 2A-G, however the container grip can be designed to resemble various animals with ears and legs, such as dogs, cats, monkeys, tigers, mice, etc. FIGS. 1A-D show the orientation on the bottle can be inserted from since both sides of the Animal Faces container grip may be identical. Design variation 2 of the animal character, embodiment 101, shows the design example with an asymmetrical front and back for one-way assembly of the bottle and the bottle holder.

Figure 1A:
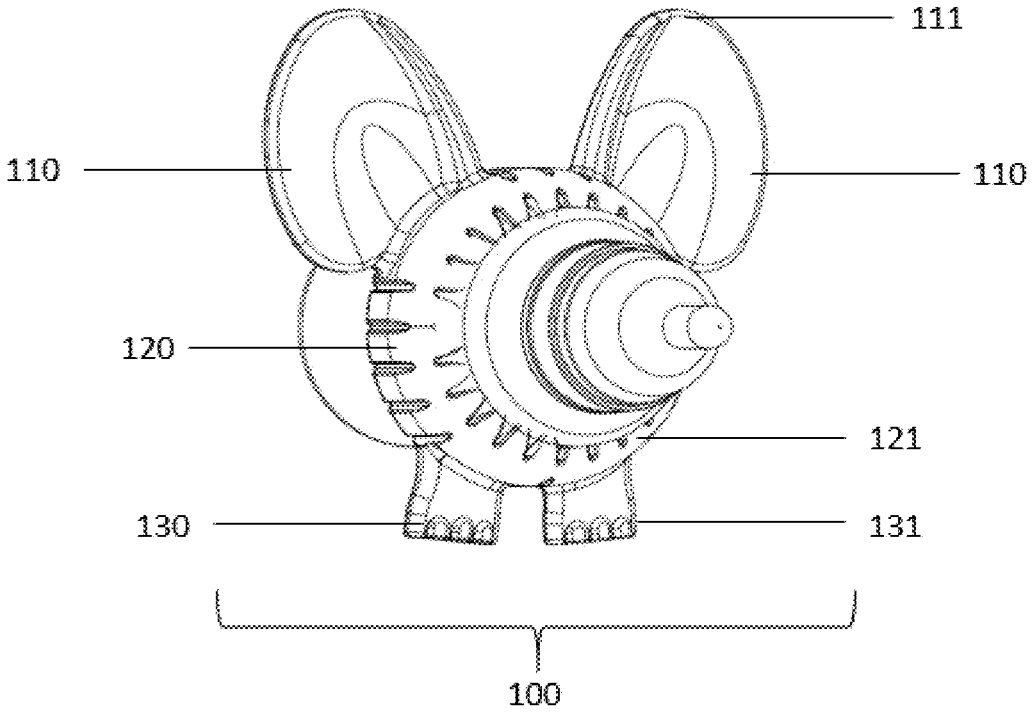
FIG. 1A is a front side isometric view of an embodiment of an animal character bottle gripper and baby teether design variation 1 with bottle inserted.
Figure 1B:
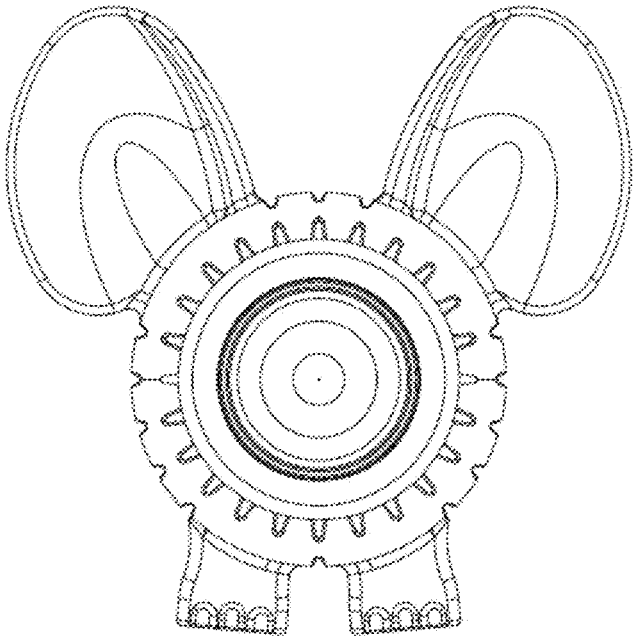
FIG. 1B is a front view drawing of the animal character bottle gripper and baby teether design variation 1 with bottle inserted.
Figure 1C:
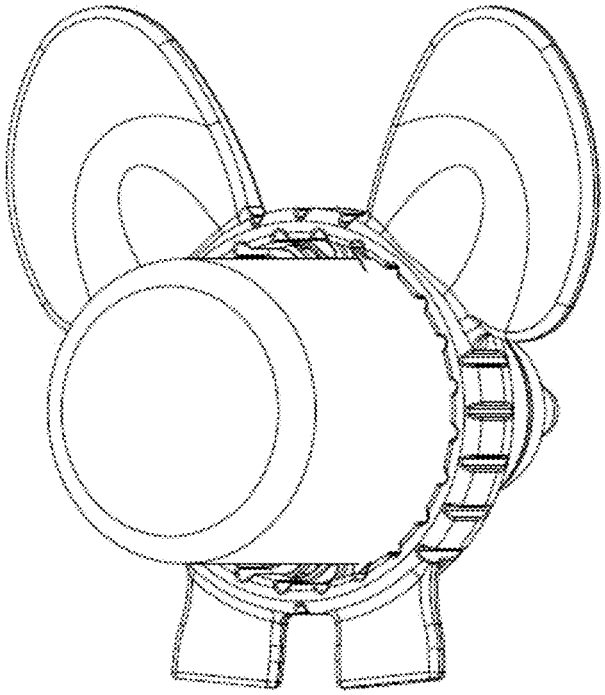
FIG. 1C is a rearview isometric drawing of the animal character bottle gripper and baby teether design variation 1 with bottle inserted.
Figure 1D:
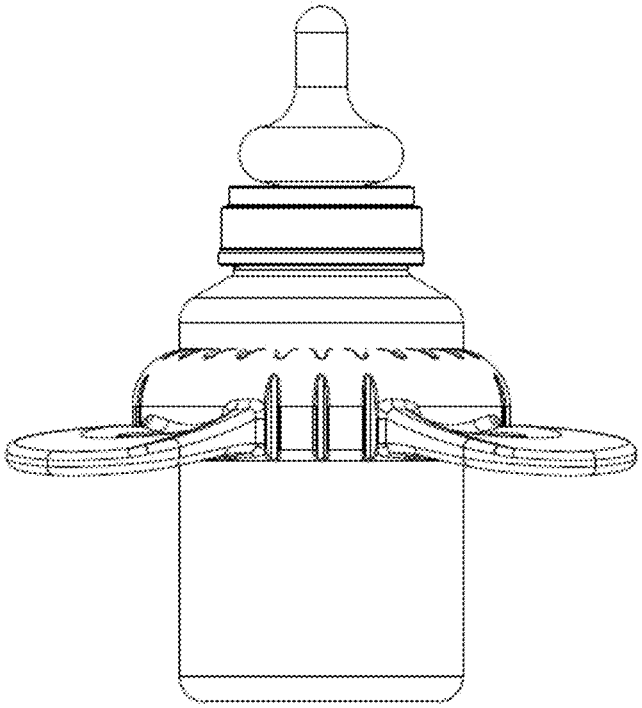
FIG. 1D is a top view drawing of the animal character bottle gripper and baby teether design variation 1 with bottle inserted.
Figure 1E:
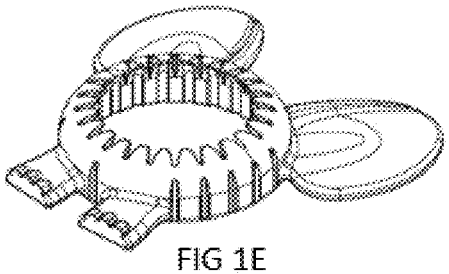
FIG. 1E is a front side, top view isometric drawing of the animal character bottle gripper and baby teether design variation 1.
Figure 1F:
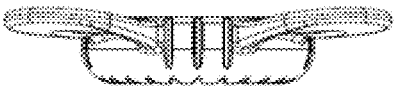
FIG. 1F is a top view drawing of the animal character bottle gripper and baby teether design variation 1.
Figure 1G:
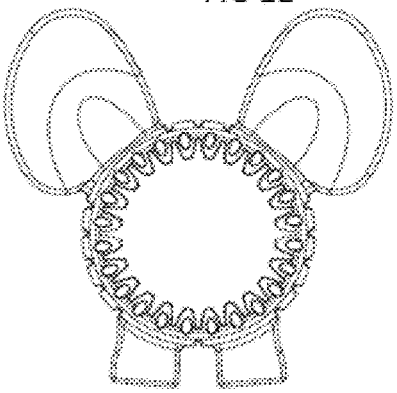
FIG. 1G is a backside view drawing of the animal character bottle gripper and baby teether design variation 1.
Figure 1H:
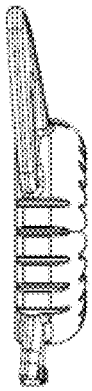
FIG. 1H is a side view drawing of the animal character bottle gripper and baby teether design variation 1.
Figure 1I:
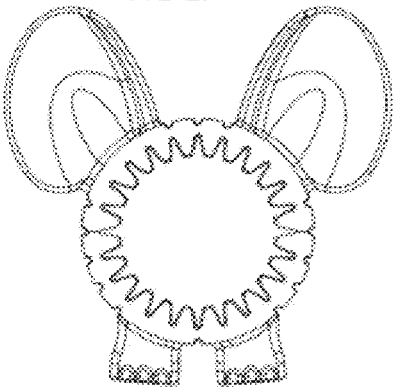
FIG. 1I is a front side drawing of the animal character bottle gripper and baby teether design variation 1.
Figure 2A:
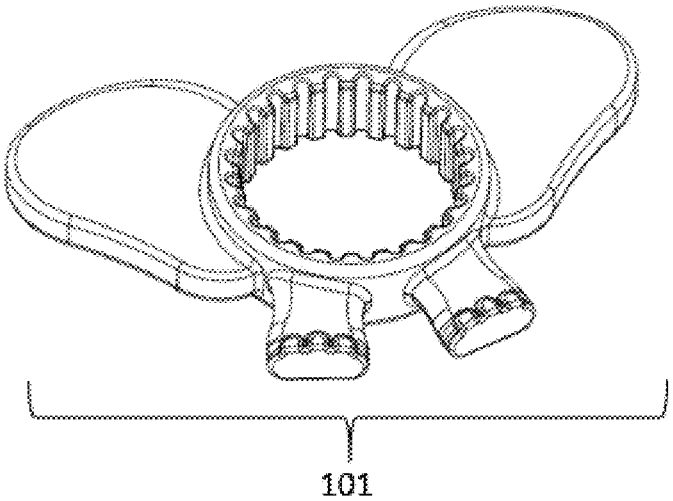
FIG. 2A is a front side, top view isometric drawing of an embodiment of an animal character bottle gripper and baby teether design variation 2.
Figure 2B:
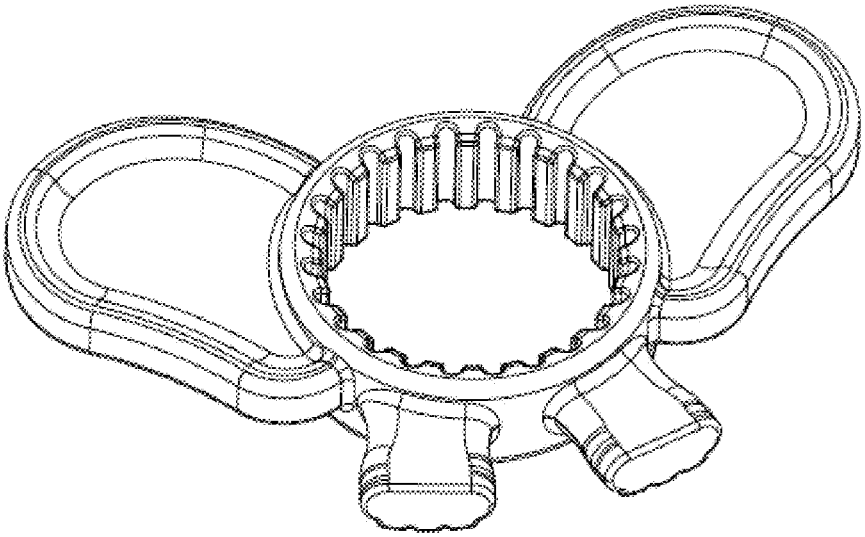
FIG. 2B is a back side, top view isometric drawing of the animal character bottle gripper and baby teether design variation 2.
Figure 2C:
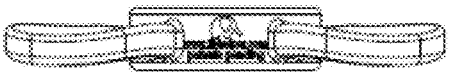
FIG. 2C is a top view drawing of the animal character bottle gripper and baby teether design variation 2.
Figure 2D:
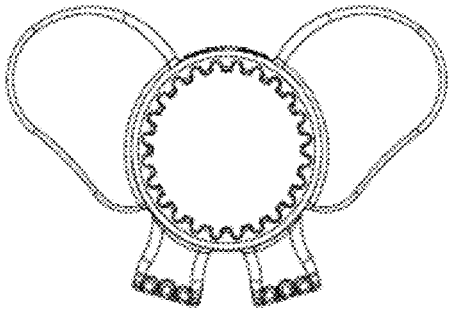
FIG. 2D is a front side drawing of the animal character bottle gripper and baby teether design variation 2.
Figure 2E:
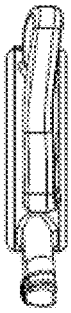
FIG. 2E is a side view drawing of the animal character bottle gripper and baby teether design variation 2.
Figure 2F:
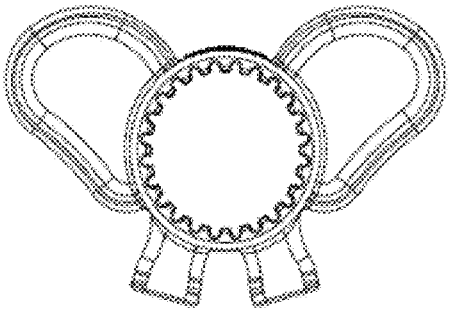
FIG. 2F is a back side drawing of the animal character bottle gripper and baby teether design variation 2.
Figure 2G:
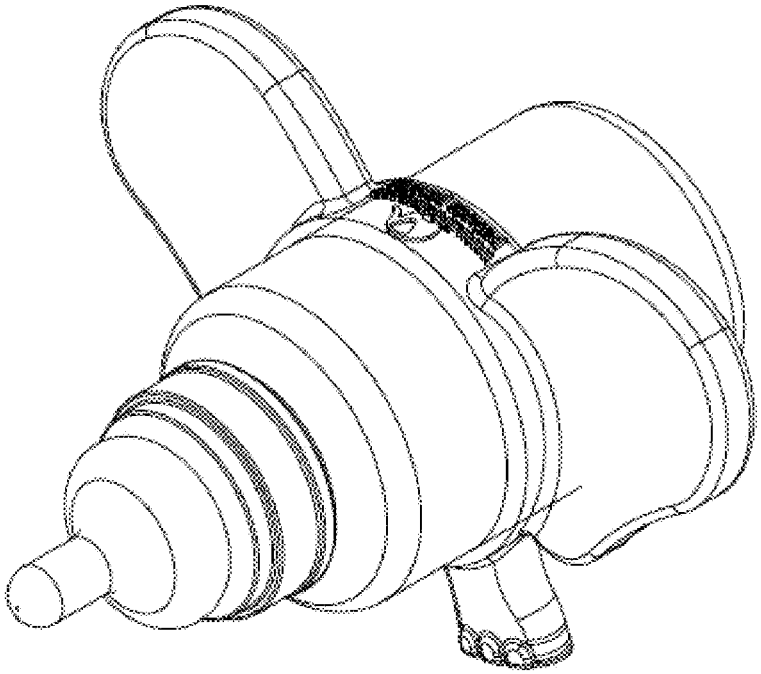
FIG. 2G is an isometric view of the animal character bottle gripper and baby teether design variation 2 installed on a bottle.
Figure 3:
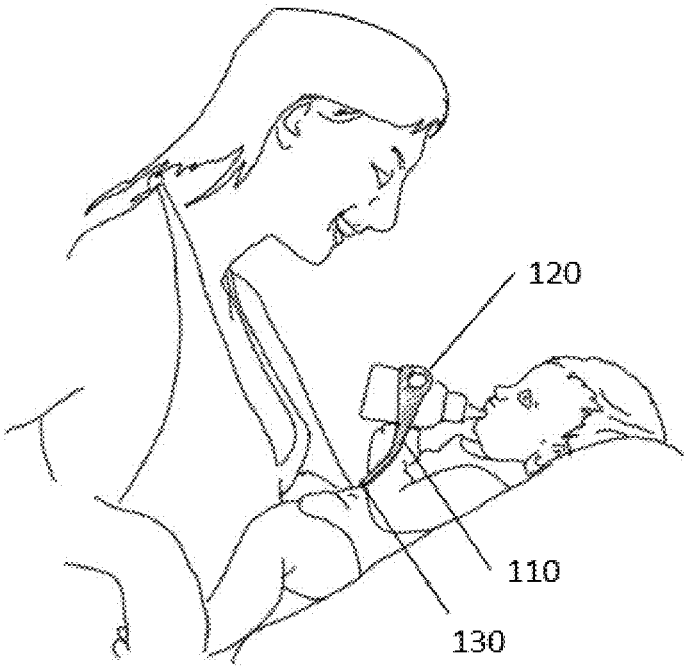
FIG. 3 is a side view of an embodiment of the bottle gripper invention in application for self-nursing.

FIG. 1A illustrates that the animal's legs or feet for this design concept, element 130, act as the base to rest on a baby's chest in the self-feeding application and the ears for stability, element 110, may be used as handles for the baby or toddler to hold onto with their hands.

In some versions, FIGS. 1A-I "animal character" gripper design concept can be made entirely of an elastomer material, such as silicone of various hardnesses, for either the bottle holder frame support and/or for teething applications. FIGS. 1A-I and 2A-G show designs for both teething and container gripper applications. All following designs represent the conceptual path of exploring and identifying designs for a grip holder for various containers for self-feeding applications.

FIGS. 4A-G, show versions of the Arched/Bent gripper combination design, embodiment 102. Embodiments 103 to 106 are bent frame variations but not arched base of this design concept. One option is the variance in thickness of the bottle holder and grip frame, element 170. Another option is the angle of the hang pin like grips can be widened for larger bottle and cup diameters, element 150 between elements 123 and 122 that are comprised in the gripper area, element 120, however will still provide a range of diameters for bottles. Another option is to mold the grip holder closed or open, shown in element 160, to increase or decrease the natural tendency of the plastic in the grip holder to open or close around a container. Another option is to add a rib across the center of the frame for added strength and extra grip space.

Figure 5A:
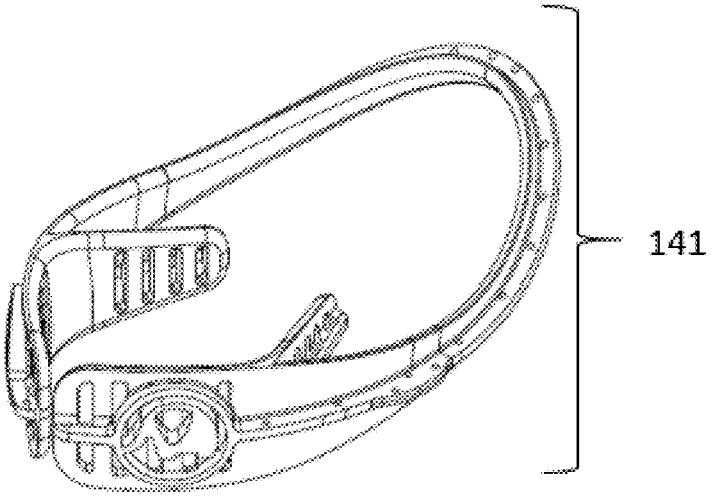
FIG. 5A is an isometric view of an embodiment of a plastic insert for the arched and/or bent combination gripper design concept for manufacturing.
Figure 5B:
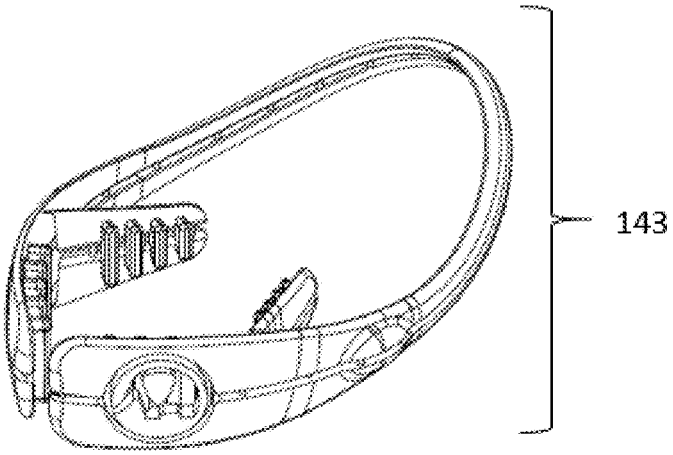
FIG. 5B is an isometric view of an embodiment of a, elastomer overmold component that is molded over a plastic frame shown in FIG. 5A for the arched and/or bent combination gripper design for manufacturing.
Figure 5C:
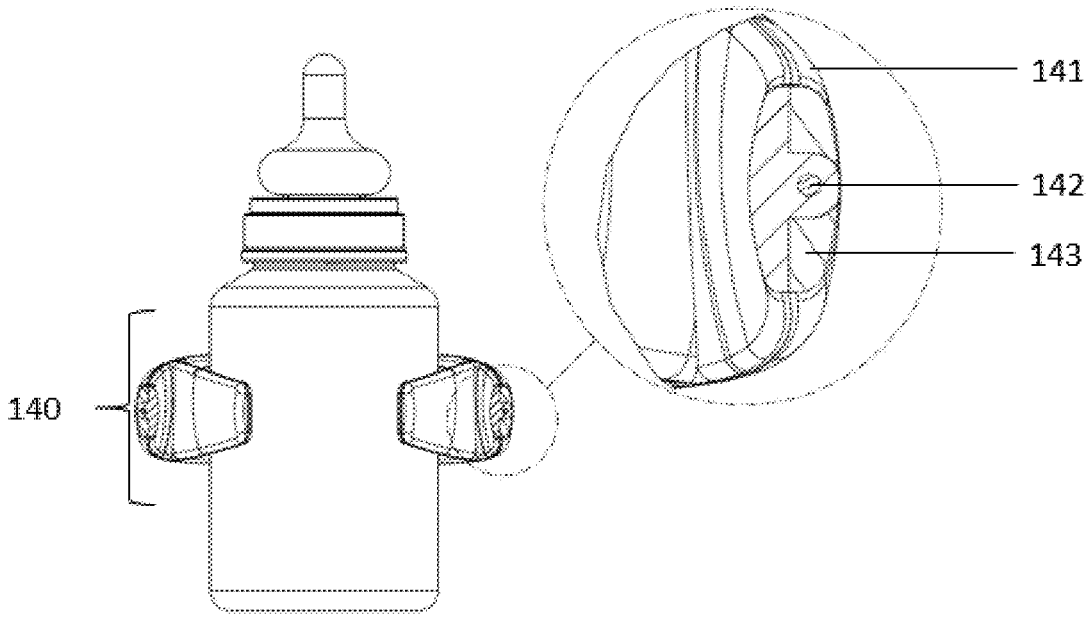
FIG. 5C is a cross-sectional view of the arched and/or bent combination gripper design that illustrates a wire insert can be inserted inside the hard plastic frame of FIG. 5A.

Another option illustrated in FIG. 5C is to over mold a steel spring wire, element 142, of varying diameter with polypropylene or other plastic, element 141 to add strength to the frame of the grip holder, element 140, and reinforce the shape of the grip holder. Ears, feet, bumps or rounds can be added to the bottom portion of the frame to allow the grip holder to stand and rest easier on a baby's chest. Also the protruding ears, feet, bumps or rounds can be added as a design style feature or holding assistance such as element 112. The sticky, tacky, rubber grips that are over-molded on the hard plastic in the hang pin clamps can be various shapes, thickness, and profiles for teething options and added grip shown in element 111. Another option is the overall shape of the grip holder can be made more circular with varying diameter or more elliptical to accomplish for different baby's, toddlers or children attributes for better grip and hold uses and different container types.

Figure 4A:
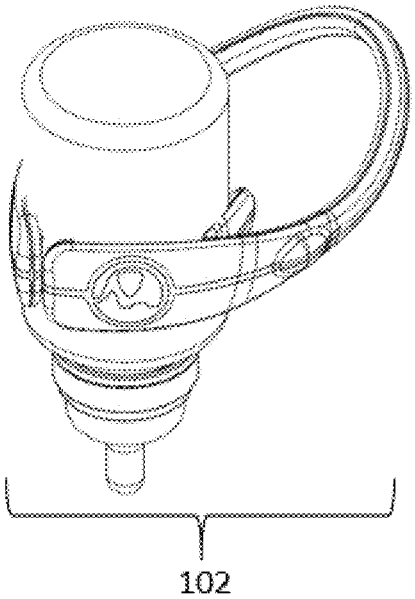
FIG. 4A is an isometric view drawing of an embodiment of an arched and bent combination gripper design variation with bottle inserted.

In FIG. 4A, "Arched" refers to the narrow apex at the bottom of the grip holder frame that resembles an arched-like profile at the apex of element 130 in a vertical arch viewing from the side. "Bent" refers to the side profile of the grip holder frame being angled up at the base, element 130 of the gripper to the gripper area of the device, element 120, to have a bent-like profile compared to the horizontal area at the top of the grip holder illustrated in FIG. 4G. The top of the grip holder indicates the area above where the container is placed between the grip arms and gripper pads. The gripper arms on each side of the grip holder are not connected so that the sides may be pulled apart to insert container and released to clamp onto the container for application.

Figure 4B:
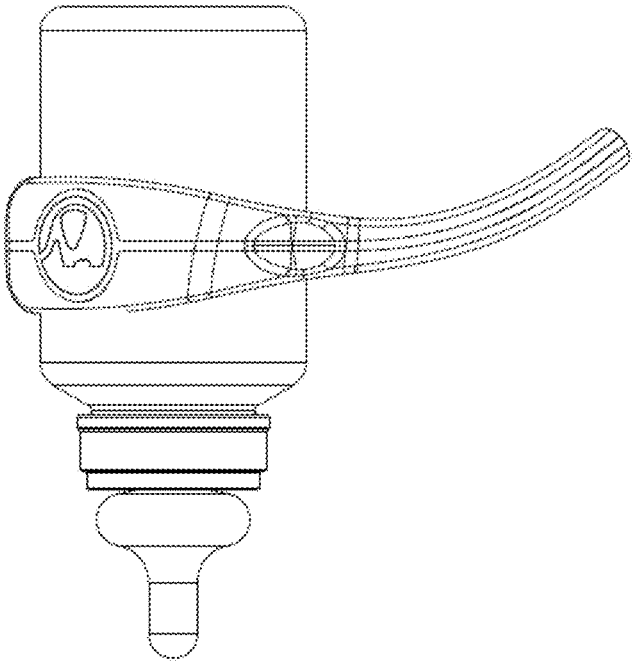
FIG. 4B is a side view drawing of the arched and bent combination gripper design variation with bottle inserted.
Figure 4C:
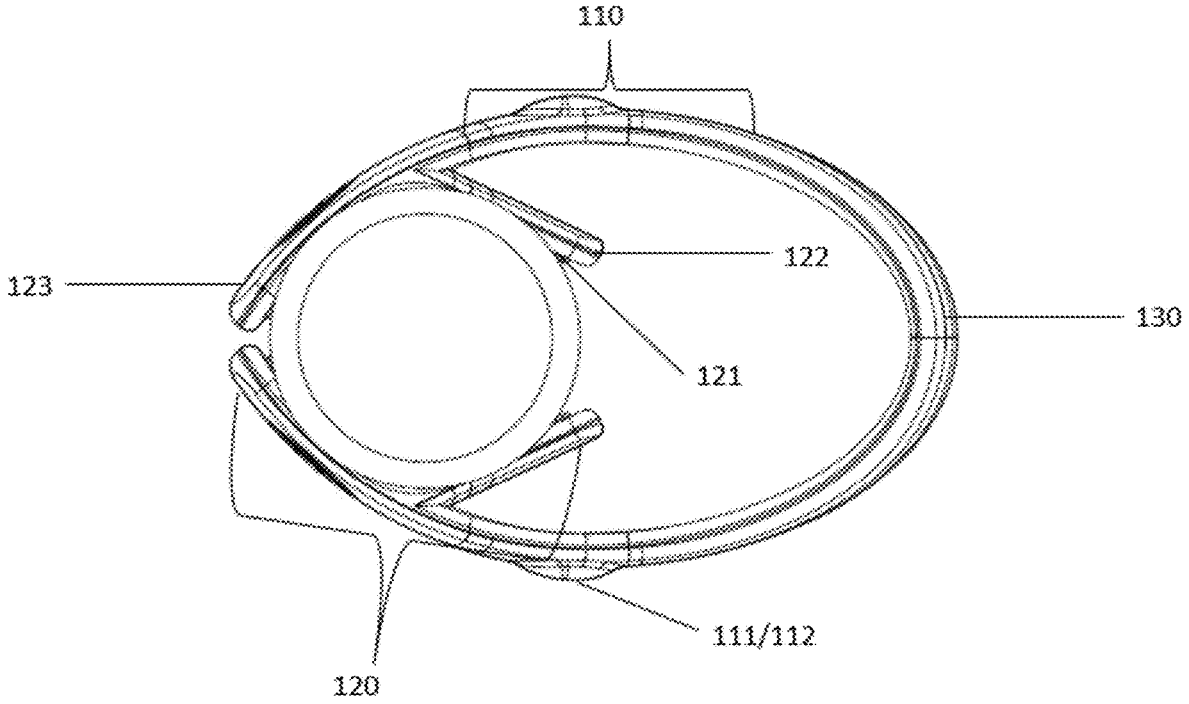
FIG. 4C is a top view drawing of the arched and bent combination design variation with bottle inserted.
Figure 4D:
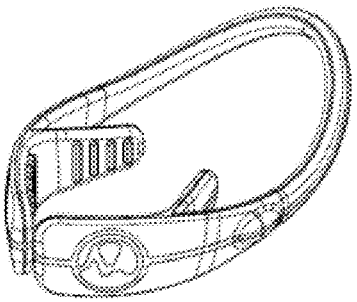
FIG. 4D is an isometric view drawing of the arched and bent combination gripper design.
Figure 4E:
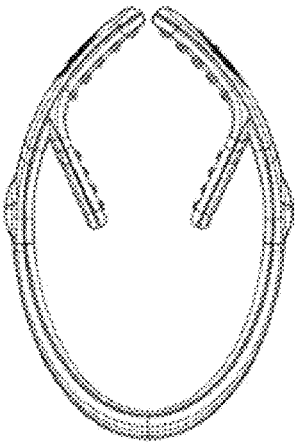
FIG. 4E is a top view drawing of the arched and bent combination gripper design.
Figure 4F:
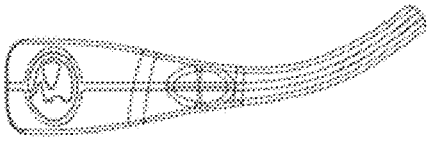
FIG. 4F is a side view drawing of the arched and bent combination design.
Figure 4G:
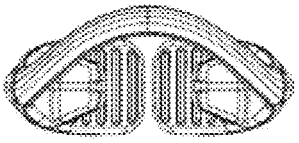
FIG. 4G is a rearview drawing of the arched and bent combination gripper design.

FIG. 4C indicate a bump, element 112, on the side of the frame that can be used as a grip or stopper for a baby's hand to improve ergonomics of a baby to hold onto the grip holder. The ideal location for this bump is so the hand will be in line with the bottom of the baby bottle in application for the appropriate leverage and weight distribution for tilting the bottle as shown in FIG. 4B.

Figure 6A:
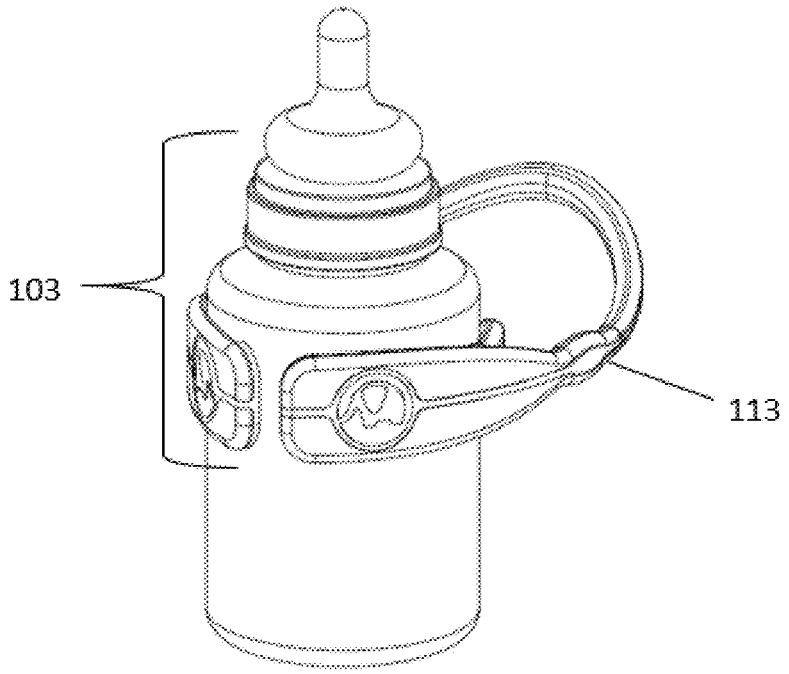
FIG. 6A is an isometric view drawing of an embodiment of a bent gripper design variation 1 with bottle inserted.

FIG. 4C is a top perspective of the Arched Gripper "bump" version with bent side profile. There may also be a recess added to the side profile in this area (AKA "hump") or there may be no bump or hump as illustrated in following design variations. Element 113 that is being called the "hump" is shown in FIG. 6A.

Figure 6B:
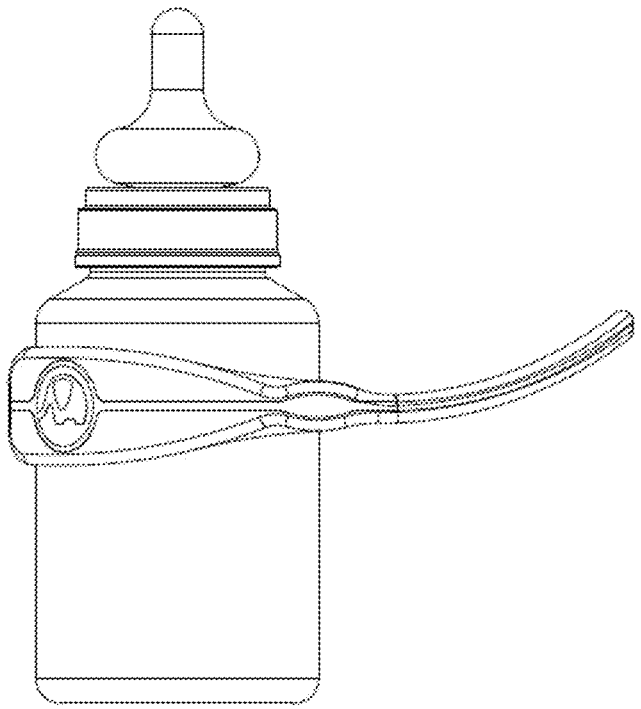
FIG. 6B is a side view drawing of the bent gripper design variation 1 with bottle inserted.
Figure 6C:
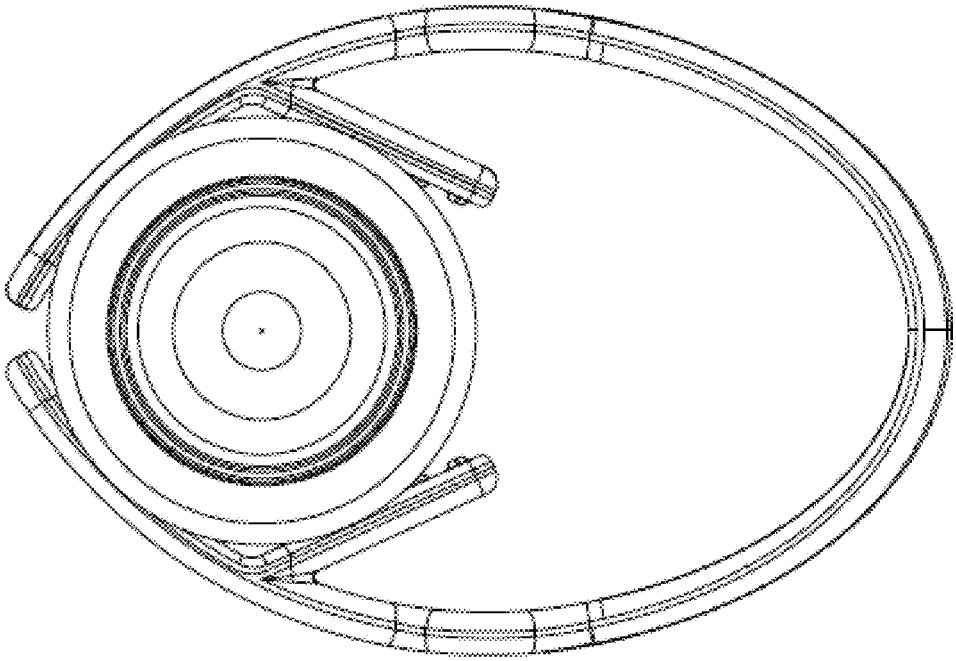
FIG. 6C is a top view drawing of the bent gripper design variation 1 with bottle inserted.
Figure 6D:
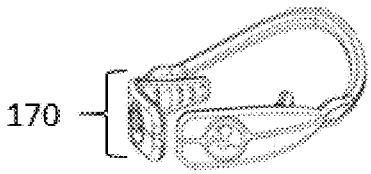
FIG. 6D is an isometric view drawing of the bent gripper design variation 1.

FIG. 6B is a side view of the Bent Gripper design variation with a "hump" feature added along the top and bottom of a side profile below the gripper arm apex. Note: A "hump" feature of FIG. 6B and a "bump" of FIG. 4C can both be incorporated to the same design.

FIG. 5C shows the base hard plastic component, element 141, and the rubbery component, element 143, to be over-molded over the base hard plastic (and possibly a third metal wire to be over-molded by the hard plastic, element 142). There are various holes shown in the hard plastic to be over-molded with rubbery, tacky material so that the two materials do not separate easily. The over-mold soft rubbery material can be TPE or silicone of different grades for tackiness, stickiness, shore-hardness, etc. A metal wire can be inserted into the plastic frame for added frame strength and spring factor when separating the gripper arms, especially when the top gripper arms are molded in the closed natural position. This is a cross-section of the Bent Gripper Design. It illustrates the use of a bent spring steel rod for greater pre-load. This design feature can be utilized in any of the design concepts with hard plastic pre-shot.

In FIGS. 10A-F and 11A-H, embodiments 107 and 108, exhibits line drawings of the planar gripper design variations showing various views of "hump" version Bent Gripper design with arched base without a bottle. Note: the grip holder frame can be various diameter/thickness of "hump" with thicker and thinner "bump" Arched gripper in these examples. The frame diameter is a variable for all grip holder designs for the Arched Gripper.

Figure 6E:
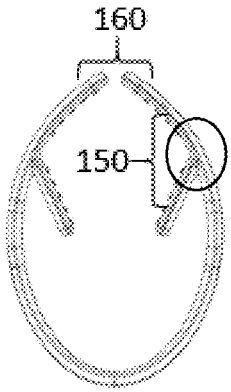
FIG. 6E is a top view drawing of the bent gripper design variation 1 with the unique angle of the gripper arms circled.
Figure 6F:
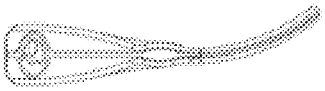
FIG. 6F is a side view drawing of the bent gripper design variation 1.
Figure 6G:
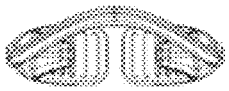
FIG. 6G is a rearview drawing of the bent gripper design variation 1.

In FIG. 6E, the line drawing showing the top perspective of the grip holder shows a sharp apex "triangle point" between top and bottle portions, elements 123 and 122 resp., of the hang-pin grippers. A radius can also be added for a rounded bridge between the top and bottle gripper arms on each side of the grip holder as shown in top perspective of line drawing for FIG. 7E.

Figure 7A:
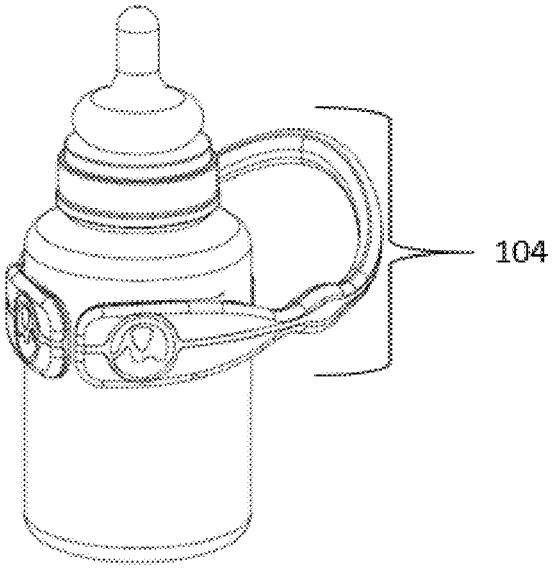
FIG. 7A is an isometric view drawing of an embodiment of a bent gripper design variation 2 with bottle inserted.
Figure 7B:
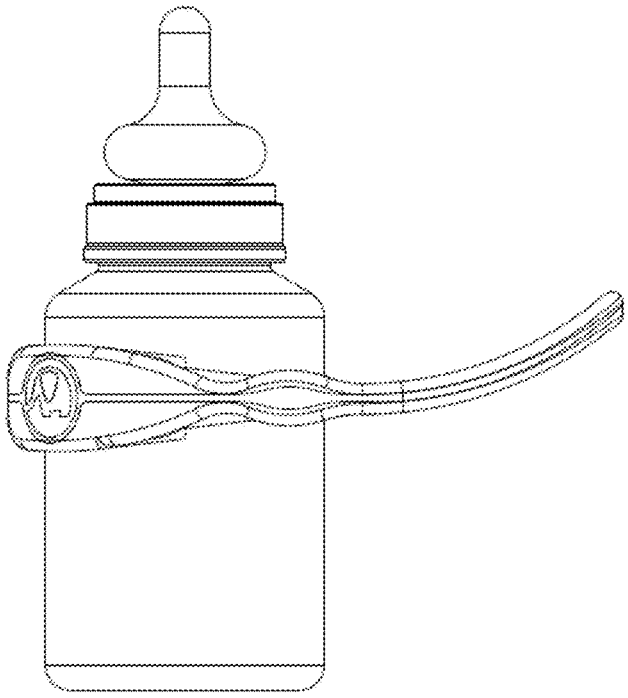
FIG. 7B is a side view drawing of the bent gripper design variation 2 with bottle inserted.
Figure 7C:
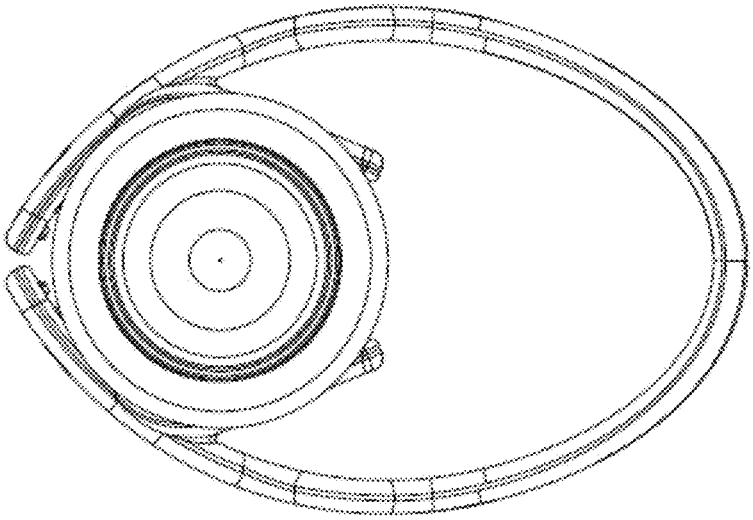
FIG. 7C is a top view drawing of the bent gripper design variation 2 with bottle inserted.
Figure 7D:
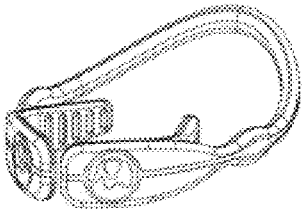
FIG. 7D is an isometric view drawing of the bent gripper design variation 2.
Figure 7E:
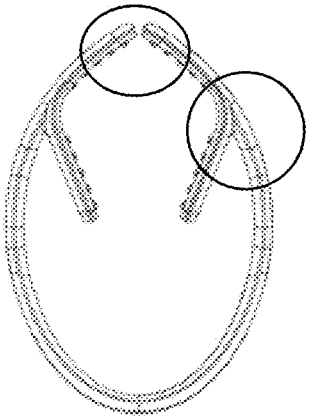
FIG. 7E is a top view drawing of the bent gripper design variation 2 with the unique angle of and distance between the gripper arms circled.
Figure 7F:
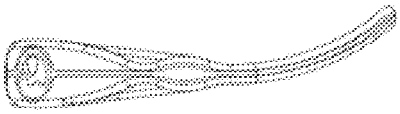
FIG. 7F is a side view drawing of the bent gripper design variation 2.

FIGS. 7A-G are various views of a very similar version of "hump" Bent gripper with arched base shown in FIGS. 6A-G. Some differences to notice in FIG. 7E are circled on the top view of line drawing perspectives:

i. Arched gripper in FIG. 7E is molded with top edges of gripper arms closer together, element 160, than gripper variation shown FIG. 6E.

ii. Bent gripper with arched base in FIG. 7E middle gripper connection is rounded at element 150 versus a sharp shown in FIG. 6E.

The difference between FIGS. 6E and 7E allow for different bottle diameters and shapes. Also, these slight variations to the gripper section (i.e. grip connection round vs. sharp and gripper top arms open vs close) can allow for better gripping surface areas or stronger grip clamping force. FIG. 7D shows how logos and branding can be added to the side walls on the frame of the grip holder.

The example shown in FIGS. 7A-E reinforces the concept that profile can be altered in a number of ways to assist with hand gripping ergonomics.

Figure 7G:
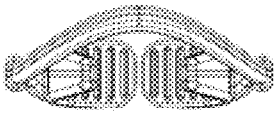
FIG. 7G is a rearview drawing of the bent gripper design variation 2.
Figure 8A:
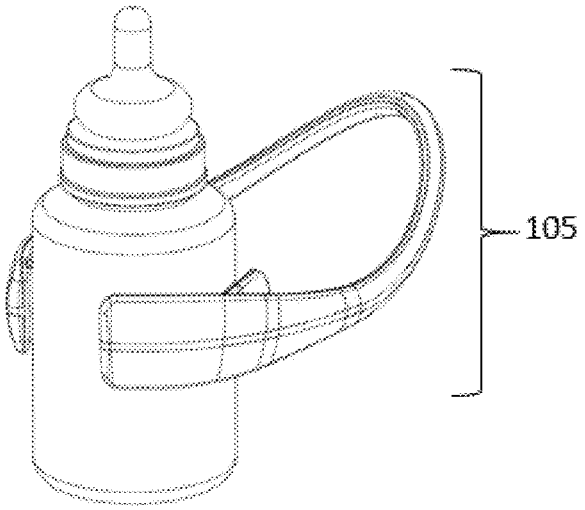
FIG. 8A is an isometric view drawing of an embodiment of a bent gripper design variation 3 with bottle inserted.
Figure 8B:
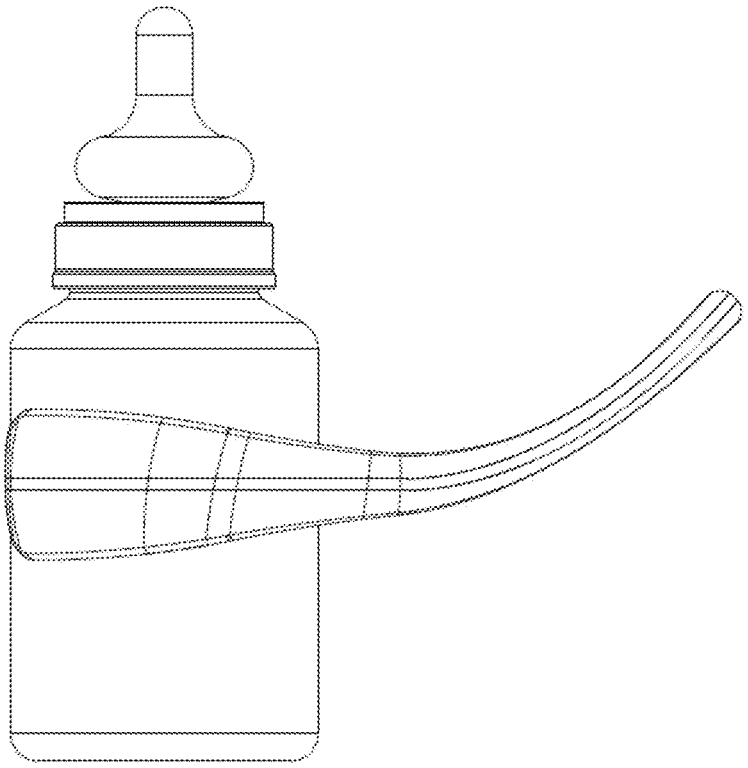
FIG. 8B is a side view drawing of the bent gripper design variation 3 with bottle inserted.
Figure 8C:
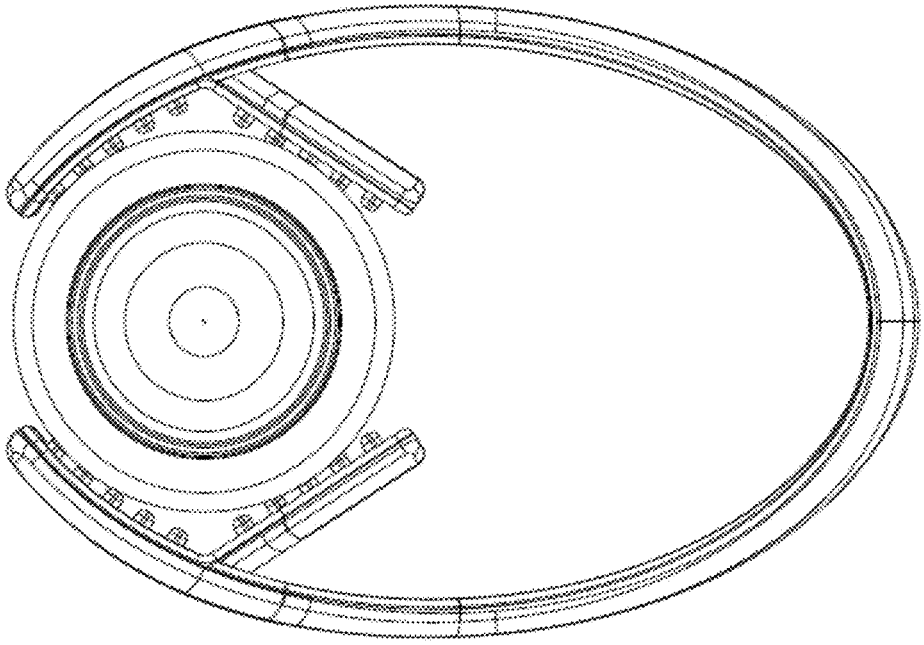
FIG. 8C is a top view drawing of the bent gripper design variation 3 with bottle inserted.
Figure 8D:
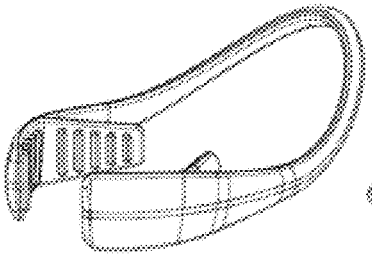
FIG. 8D is an isometric view drawing of the bent gripper design variation 3.
Figure 8E:
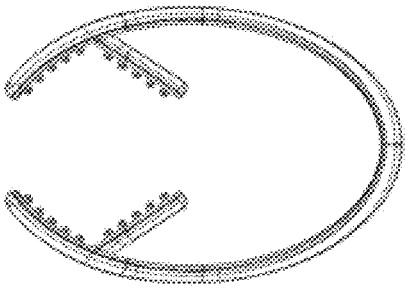
FIG. 8E is a top view drawing of the bent gripper design variation 3.
Figure 8F:
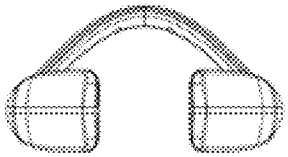
FIG. 8F is a front view drawing of the bent gripper design variation 3.
Figure 8G:
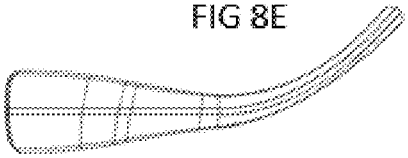
FIG. 8G is a side view drawing of the bent gripper design variation 3.

To reiterate the "arch" refers to the bottom portion below the gripping arms with respect to the horizontal surface. As shown in FIG. 7G this angle can be increased from FIGS. 6G, 8G and 9G for improving performance in baby self-feeding application.

In the embodiments 106-108 line drawings of the Bent Gripper with Arched base, but no bump nor hump along the side profile of the gripper frame compared to previous examples of embodiments 102-105. Embodiment 104 gripper arms at top portion are molded closed compared to Bent design shown in embodiment 105. FIG. 7E shows the top edges of the gripper arms are nearly touching in the natural state without a bottle for stronger clamping forces on containers placed inside the gripping arms.

Figure 9A:
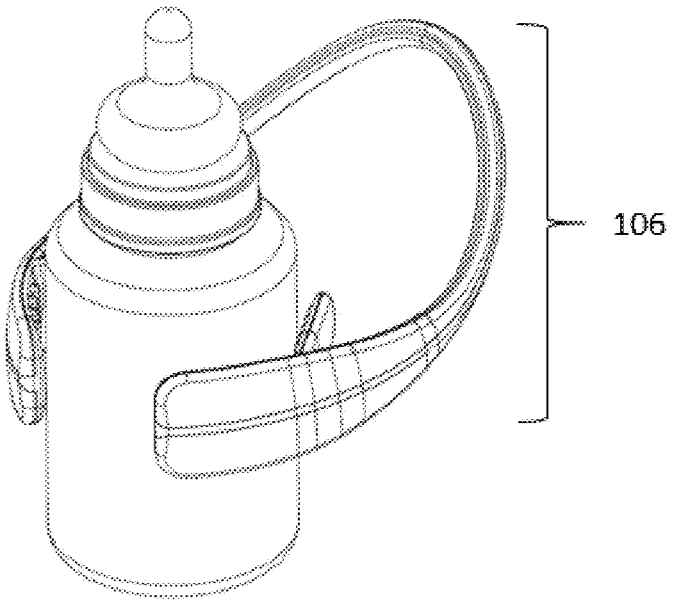
FIG. 9A is an isometric view drawing of an embodiment of a bent gripper design variation 4 with bottle inserted.
Figure 9B:
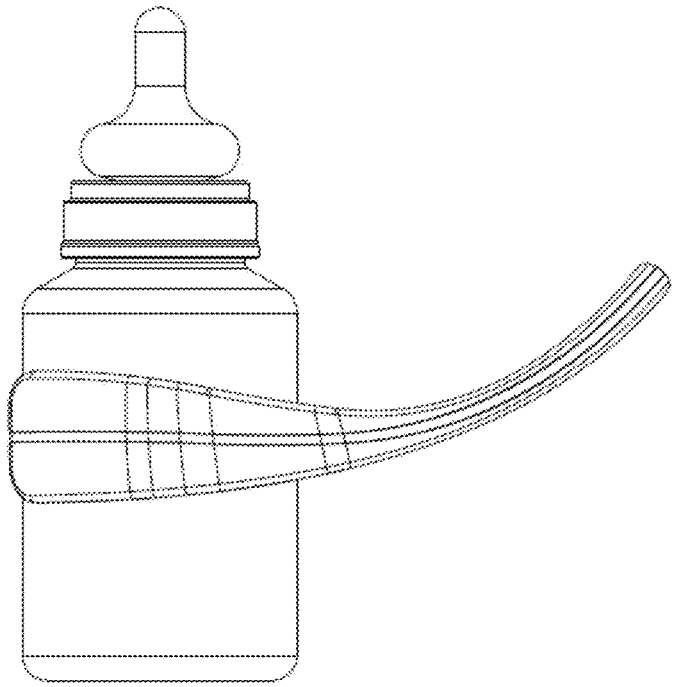
FIG. 9B is a side view drawing of the bent gripper design variation 4 with bottle inserted.
Figure 9C:
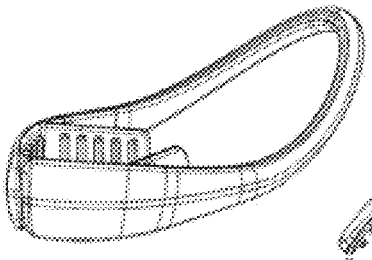
FIG. 9C is an isometric view drawing of the bent gripper design variation 4.
Figure 9D:
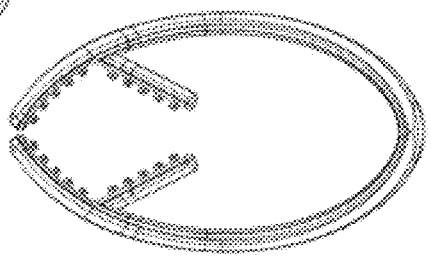
FIG. 9D is a top view drawing of the bent gripper design variation 4.
Figure 9E:
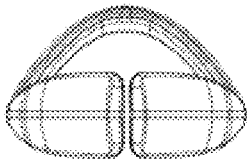
FIG. 9E is a front view drawing of the bent gripper design variation 4.
Figure 9F:
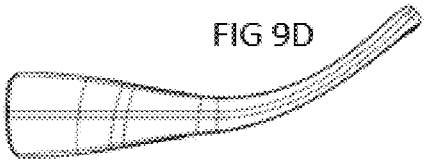
FIG. 9F is a side view drawing of the bent gripper design variation 4.

FIG. 9D shows an example with a sharp gripper apex with gripper arm angle of about 120 degrees. Both the gripper arm apex and angle can be adjusted.

FIGS. 10A-F shows examples of the gripper design without bending the side of frame profile and little to no arch on the base. This gripper example is closer to an elliptical profile shown in the top view of FIGS. 10D and 10F.

Figure 10A:
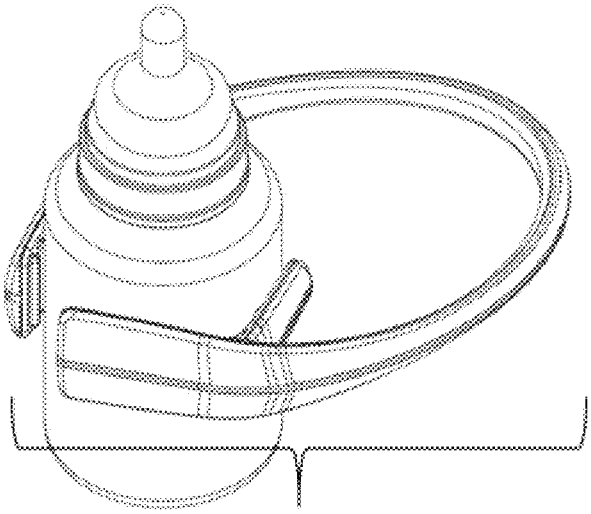
FIG. 10A is an isometric view drawing of an embodiment of a planar gripper design variation 1 concept with bottle inserted.
Figure 10B:
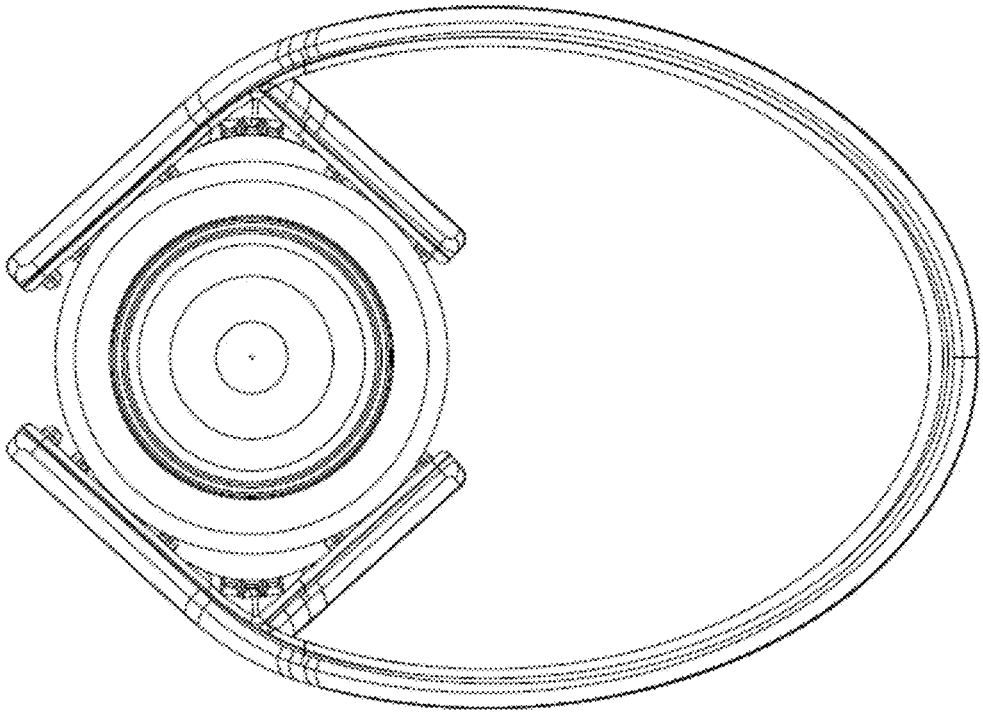
FIG. 10B is a top view drawing of the planar gripper design variation 1 with bottle inserted.
Figure 10C:
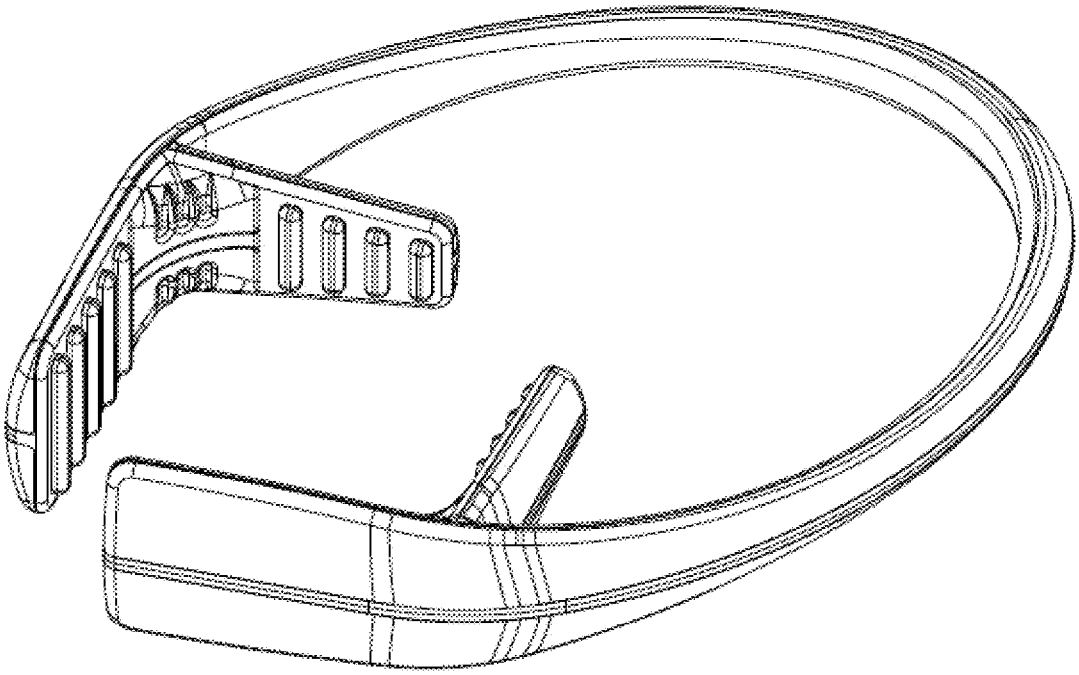
FIG. 10C is an isometric view drawing of the planar gripper design variation 1.
Figure 10D:
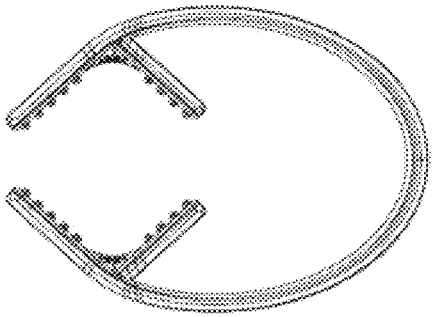
FIG. 10D is a top view drawing of the planar gripper design variation 1.
Figure 10E:
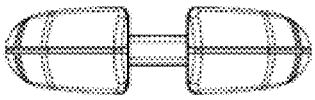
FIG. 10E is a front view drawing of the planar gripper design variation 1.
Figure 10F:
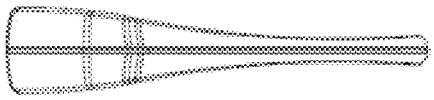
FIG. 10F is a side view drawing of the planar gripper design variation 1.
Figure 11A:
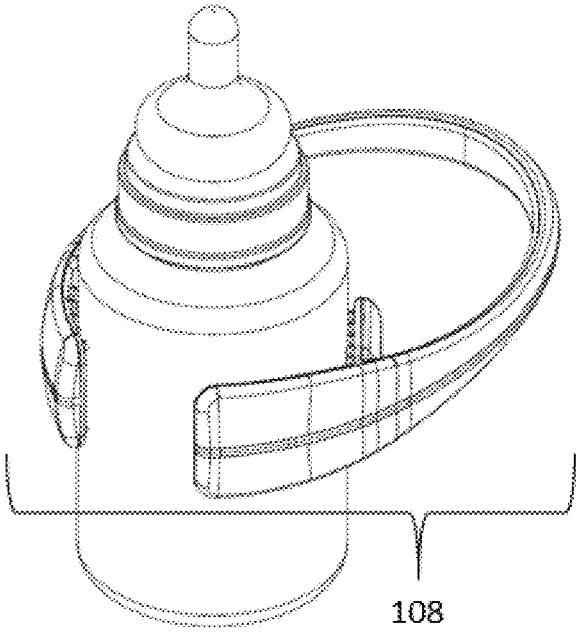
FIG. 11A is a front isometric view drawing of an embodiment of a planar gripper design variation 2 with bottle inserted.
Figure 11B:
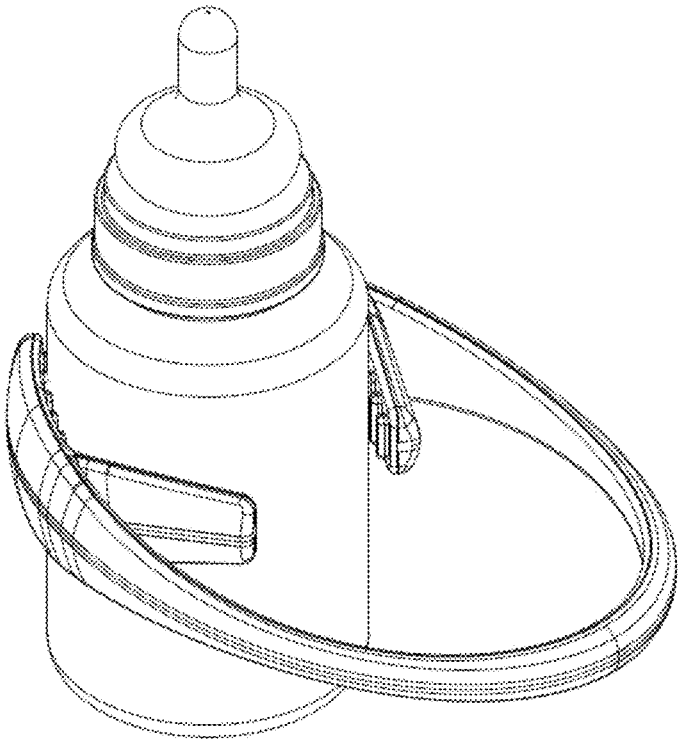
FIG. 11B is a rear isometric drawing of the planar gripper design variation 2 with bottle inserted.
Figure 11C:
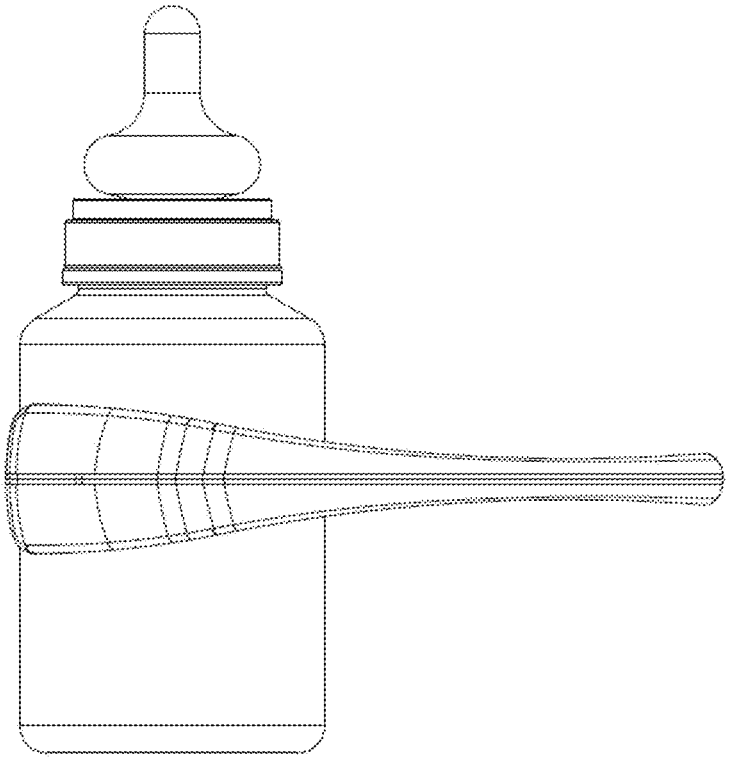
FIG. 11C is a side view drawing of the planar gripper design variation 2 with bottle inserted.
Figure 11D:
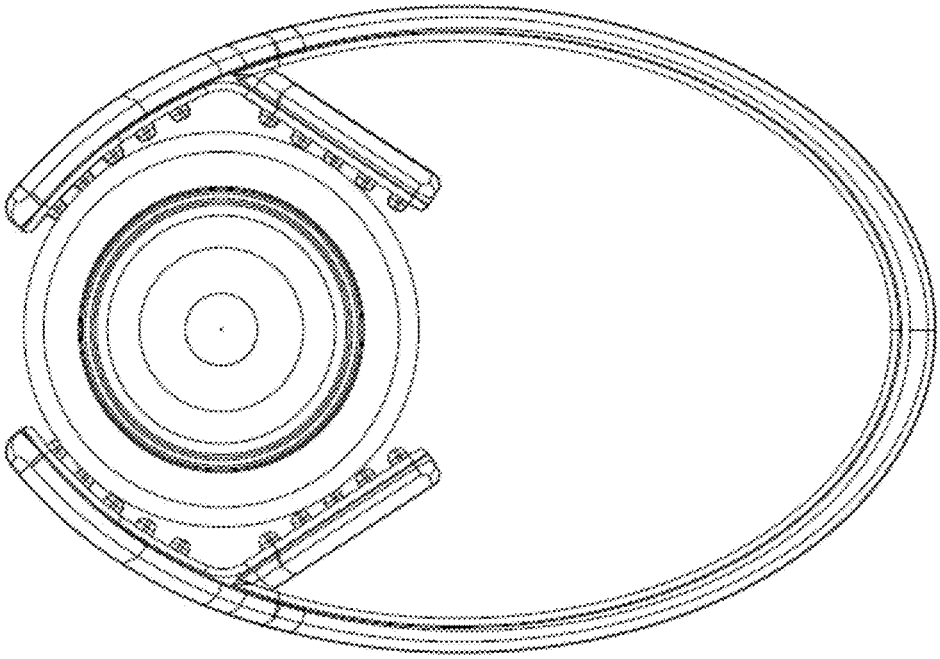
FIG. 11D is a top view drawing of the planar gripper design variation 2 with bottle inserted.
Figure 11E:
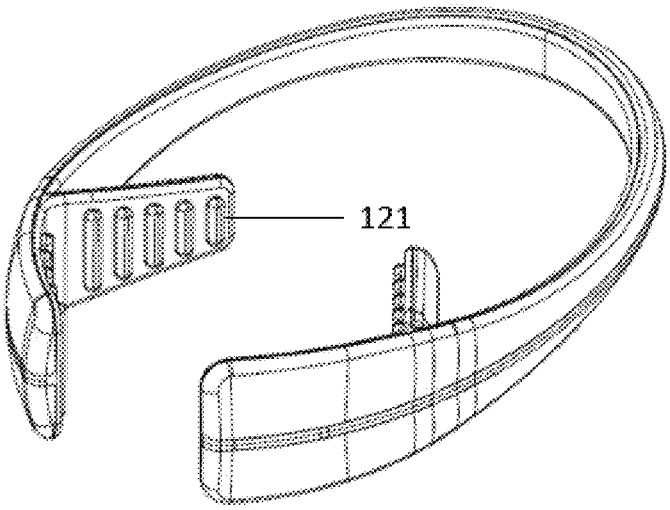
FIG. 11E is an isometric view drawing of the planar gripper design variation 2.
Figure 11F:
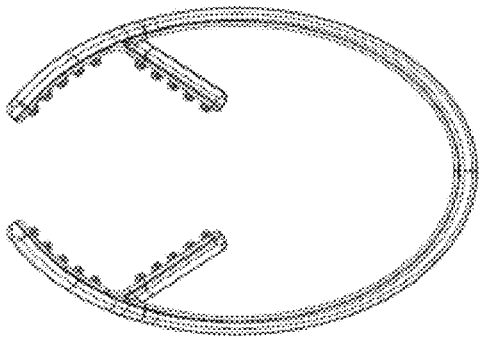
FIG. 11F is a front view drawing of the planar gripper design variation 2.
Figure 11G:
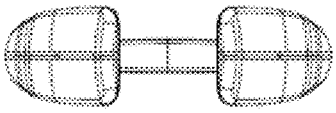
FIG. 11G is a side view drawing of the planar gripper design variation 2.
Figure 11H:
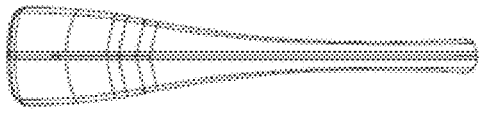
FIG. 11H is another side view of the planar gripper design variation 2.

FIG. 10C illustrates an example of the rubber gripper pads, element 121 in FIG. 11E, and web-like bridge at the grip arm apex. The gripper pads can be many variations of size, shape, configuration and number of pads. The rubber-like gripper may also be a solid wall of unspecified thickness instead of individual pads to give additional frictional surface area for the container when in application.

FIGS. 11A-H show another example of variations of gripper arm connection, gripper arm resting distance, gripper pad configuration, overall gripper holder shape and size, base profile, frame thickness and side profile.

FIGS. 12A-G shows a variation of the "Steering Wheel" concept with a fully enclosed rubber-like grip area to retain a container.

Figure 12A:
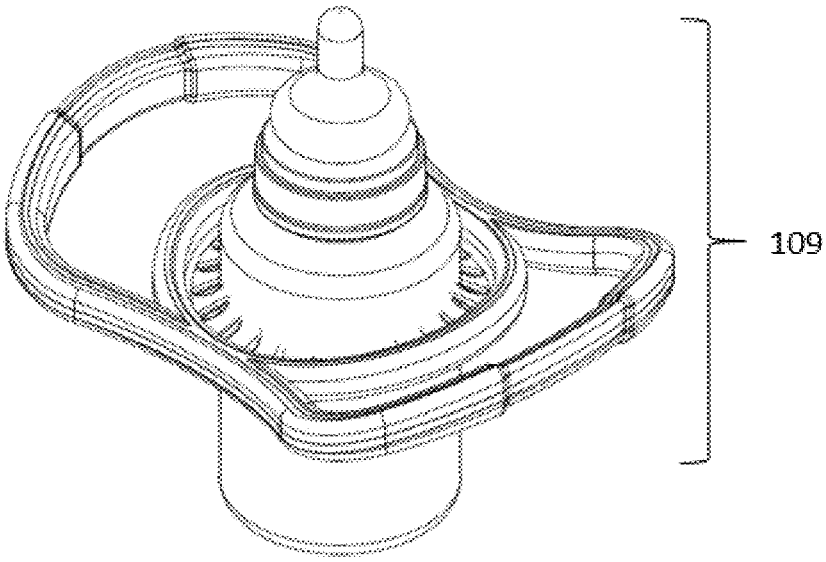
FIG. 12A is a top isometric view drawing of an embodiment of a steering wheel gripper design variation 1 with bottle inserted.
Figure 12B:
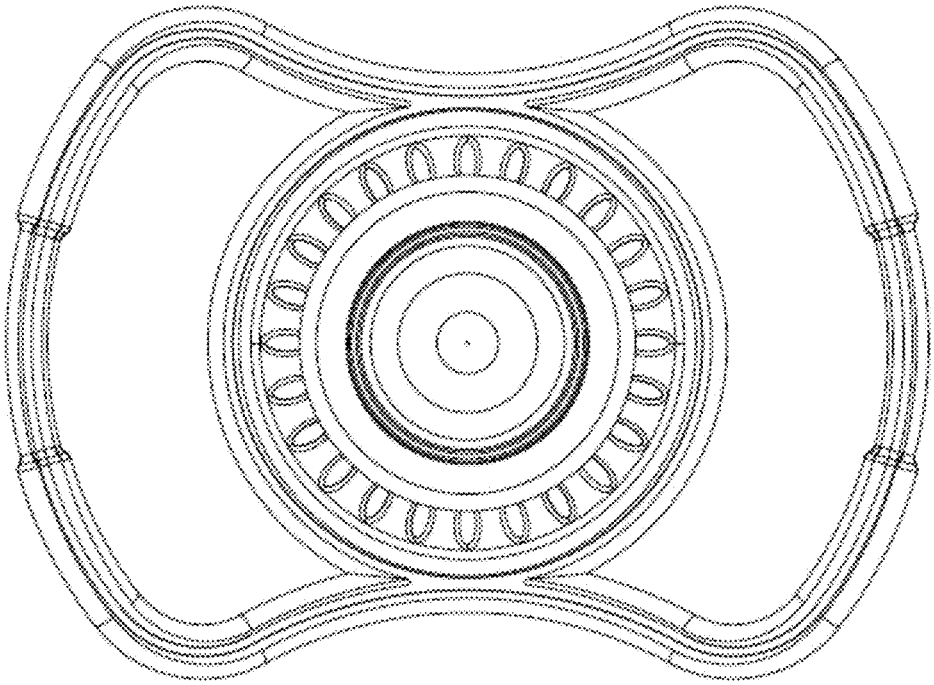
FIG. 12B is a top view drawing of the steering wheel gripper design variation 1 with bottle inserted.

FIG. 12B gives a top view perspective of a version of the bottle grip area in the center and the hand grip areas on left and right sides of the bottle grip area.

Figure 12C:
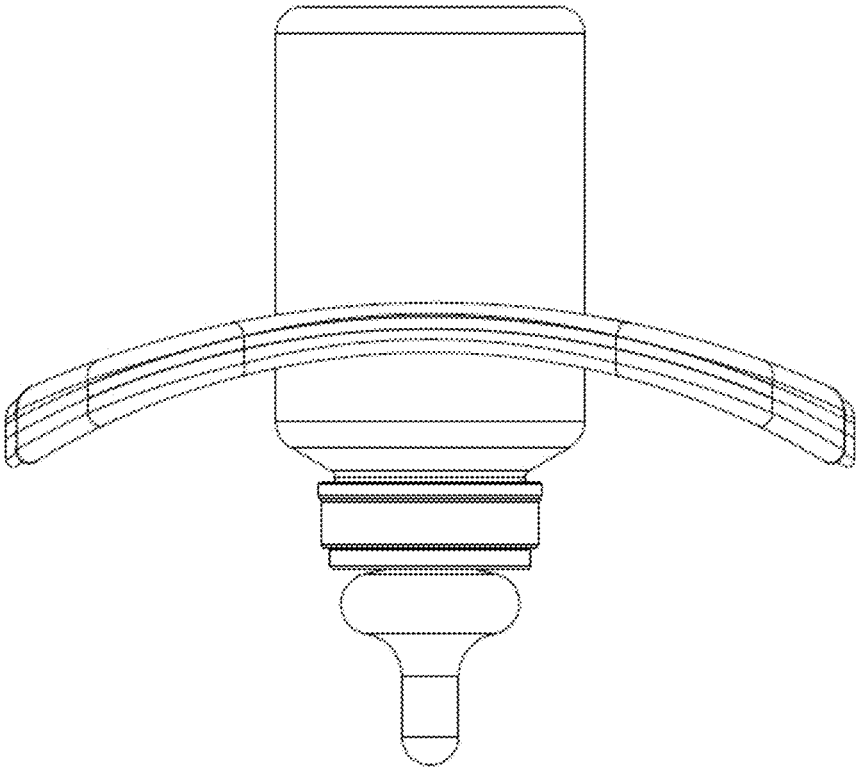
FIG. 12C is a side view drawing of the steering wheel gripper design variation 1 with bottle inserted.
Figure 12D:
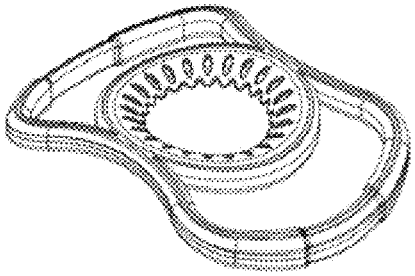
FIG. 12D is an isometric view drawing of the steering wheel gripper design variation 1.
Figure 12E:
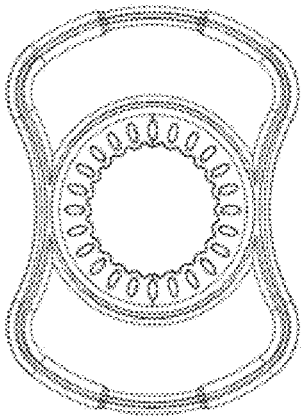
FIG. 12E is a top view drawing of the steering wheel gripper design variation 1.
Figure 12F:
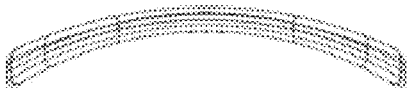
FIG. 12F is a side view drawing of the steering wheel gripper design variation 1 along the long side of the gripper.
Figure 12G:
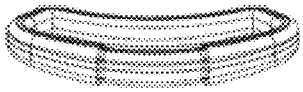
FIG. 12G is a side view drawing of the steering wheel gripper design variation 1 along the short side of the gripper.
Figure 13A:
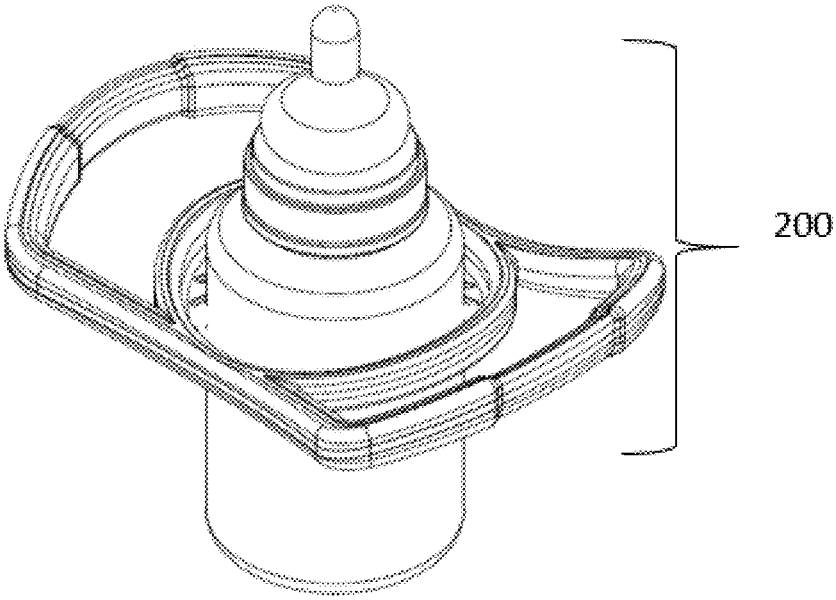
FIG. 13A is a top isometric view drawing of an embodiment of a steering wheel gripper design variation 2 with bottle inserted.
Figure 13B:
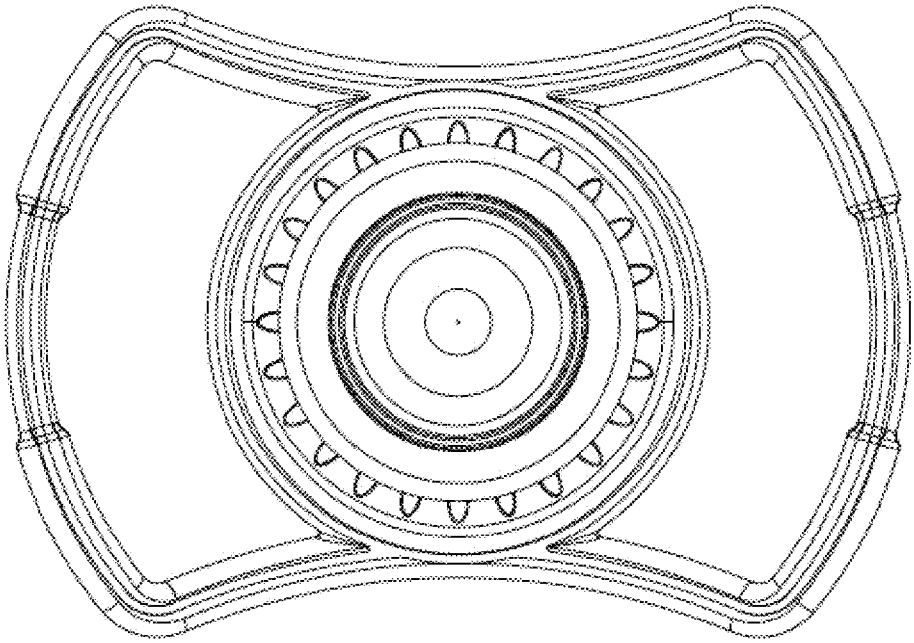
FIG. 13B is a top view drawing of the steering wheel gripper design variation 2 with bottle inserted.
Figure 13C:
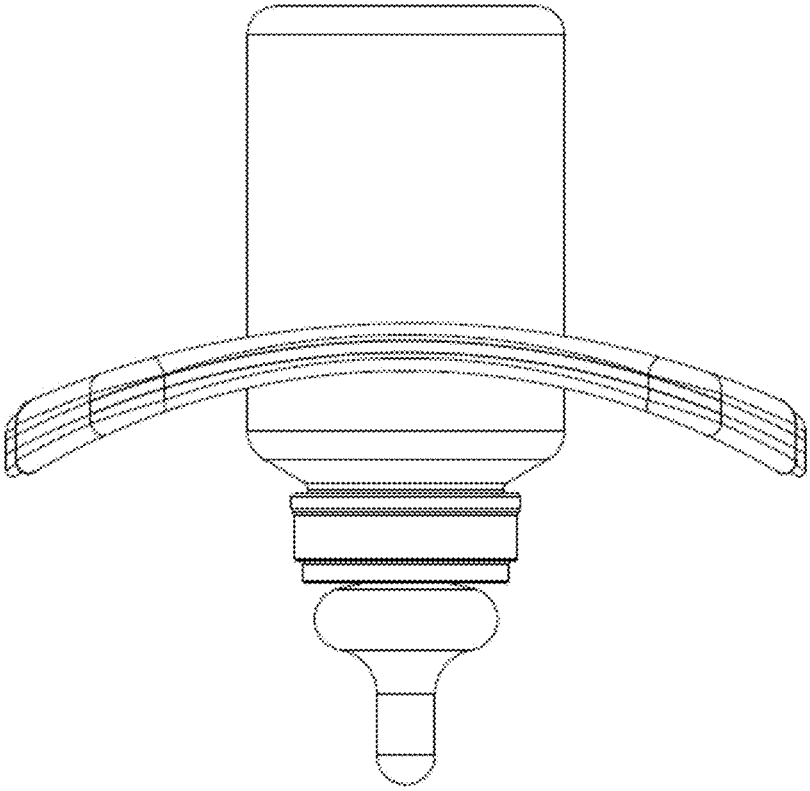
FIG. 13C is a side view drawing of the steering wheel gripper design variation 2 with bottle inserted.
Figure 13D:
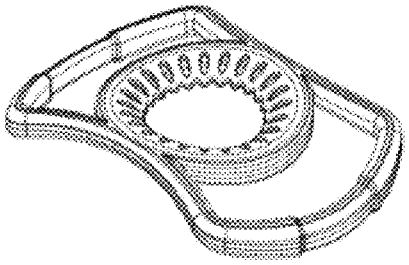
FIG. 13D is an isometric view drawing of the steering wheel gripper design variation 2.
Figure 13E:
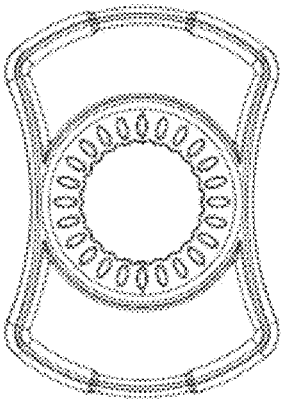
FIG. 13E is a top view drawing of the steering wheel gripper design variation 2.
Figure 13F:
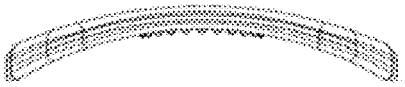
FIG. 13F is a side view drawing of the steering wheel gripper design variation 2 along the long side of the gripper.
Figure 13G:
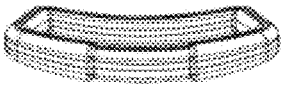
FIG. 13G is a side view drawing of the steering wheel gripper design variation 2 along the short side of the gripper.

The embodiment of FIG. 12C shows the correct orientation of the bottle in the Steering Wheel concept with respect to the curvature added to the profile of the frame. Notice the top of the bottle is inserted towards the bending edge of the Steering Wheel outer arms. The radius of curvature added to the frame profile assists with self-feeding for a baby as the baby's hand will be closer to the front of the bottle with less weight to tilt the bottle tip in the baby's mouth for self-feeding.

FIGS. 13A-G shows another variation of the Steering Wheel concept where the rubber-like enclosed area is configured differently in terms of shape and profile compared to examples shown in FIGS. 12A-G. Also, the hard plastic outer frame of embodiment 200 of FIG. 13 is distinguished from example shown in embodiment 109 of FIG. 12 in terms of size, shape, and distance from center to outer areas for hand grips.

Embodiment 201 in FIG. 14 is another design version of the Steering Wheel container grip concept where the grip area at the center of the unit is not enclosed with a rubber web to fully wrap around a bottle. This is another option for the container grip holder shown in examples of FIGS. 12 & 13.

Figure 14A:
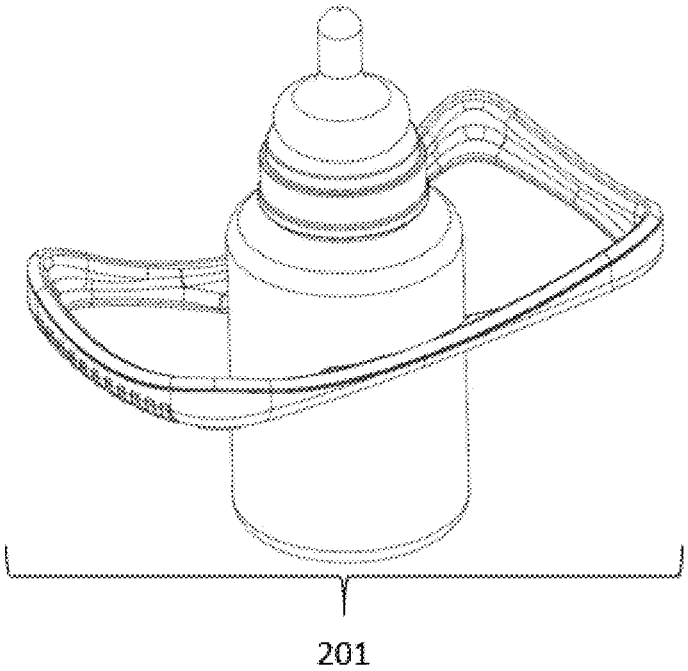
FIG. 14A is a top side isometric view drawing of an embodiment of a steering wheel gripper design variation 3 with bottle inserted.
Figure 14B:
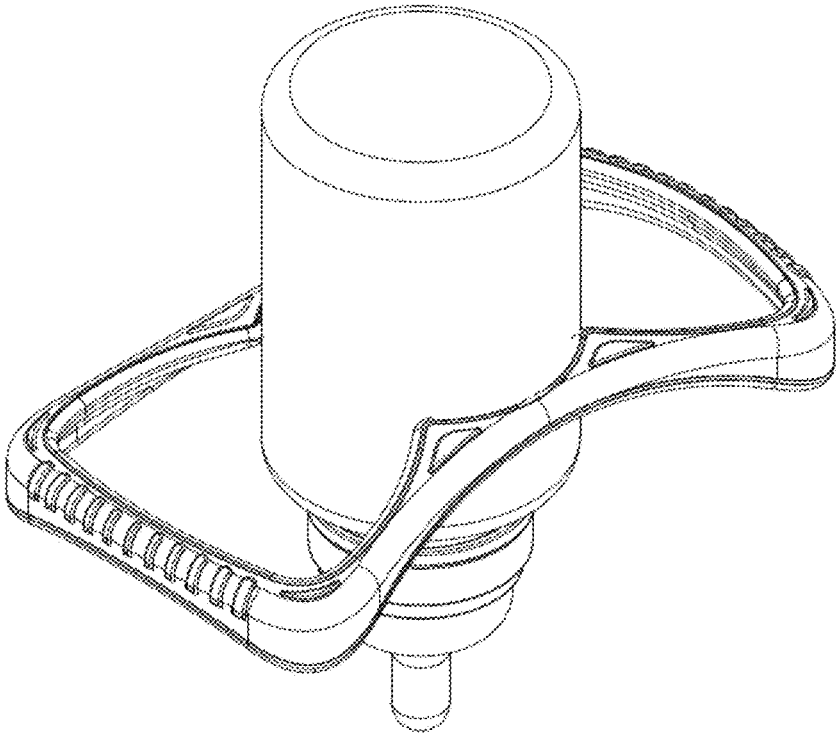
FIG. 14B is a rear side isometric view drawing of the steering wheel gripper design variation 3 with bottle inserted.
Figure 14C:
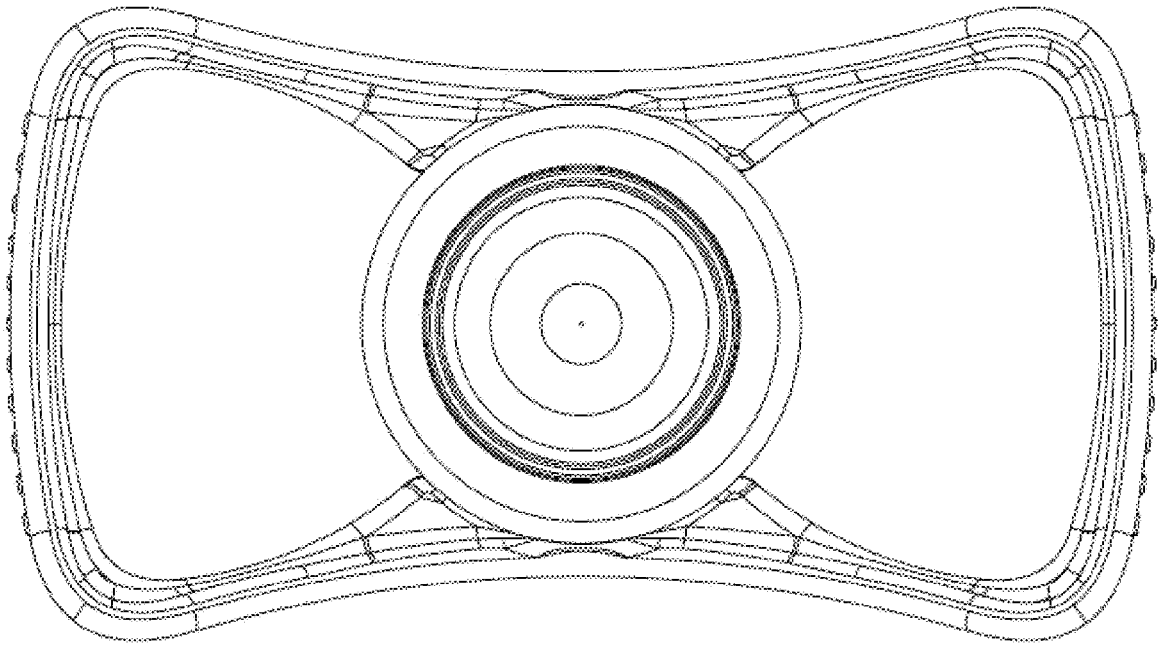
FIG. 14C is a top view drawing of the steering wheel gripper design variation 3 with bottle inserted.
Figure 14D:
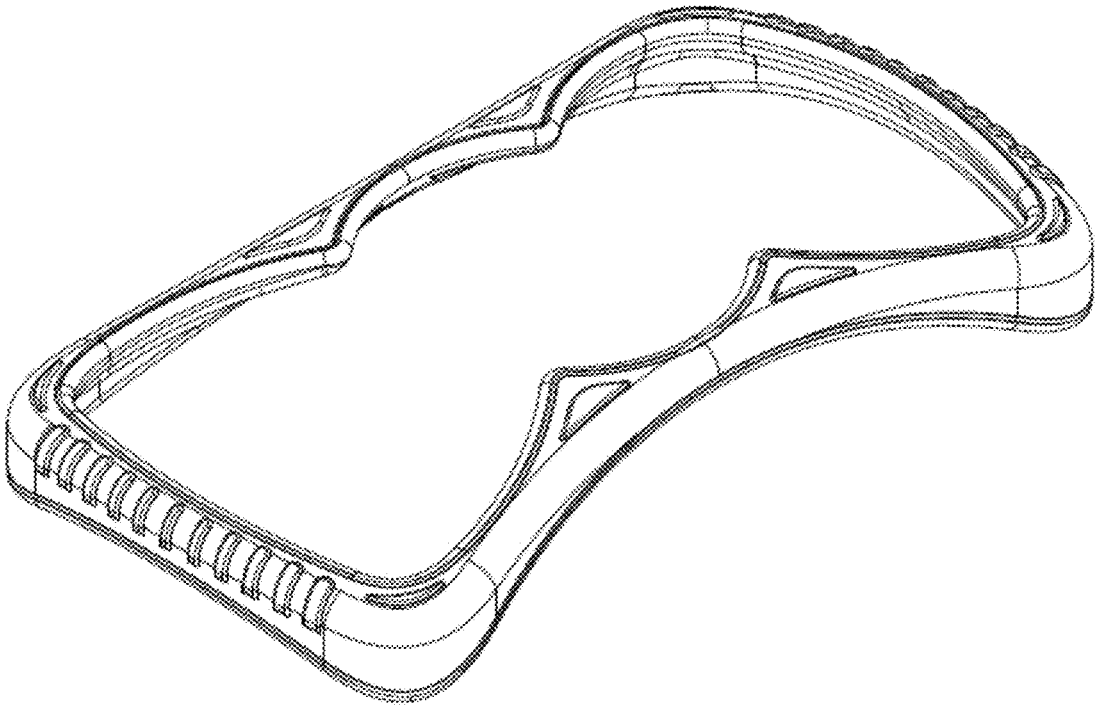
FIG. 14D is an isometric view drawing of the steering wheel gripper design variation 3.
Figure 14E:
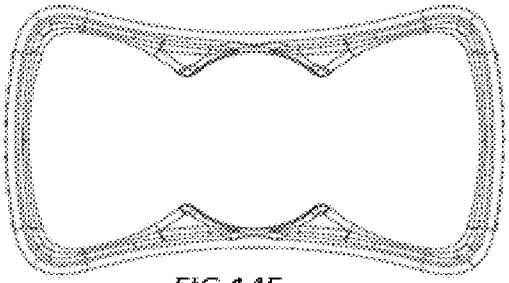
FIG. 14E is a front side top view drawing of the steering wheel gripper design variation 3.
Figure 14F:
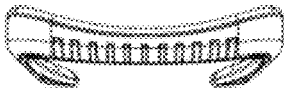
FIG. 14F is a side view drawing of the steering wheel gripper design variation 3 along the short side of the gripper.
Figure 14G:
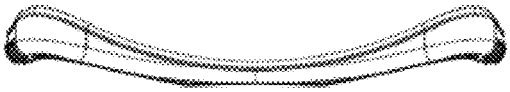
FIG. 14G is a side view drawing of the steering wheel gripper design variation 3 along the long side of the gripper.
Figure 14H:
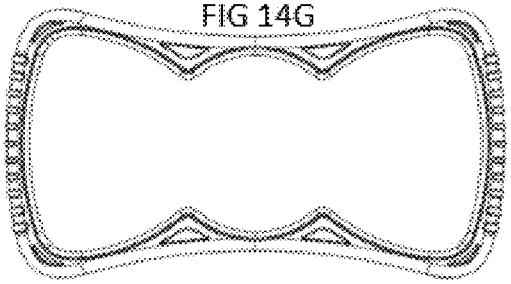
FIG. 14H is a backside top view drawing of the steering wheel gripper design variation 3.

FIG. 14B shows that an embodiment with elastomer, such as rubber-like material, can be added to the Steering Wheel arms for additional hand grip during self-feeding application and used as teethers for baby's to bite or suck on.

Figure 15A:
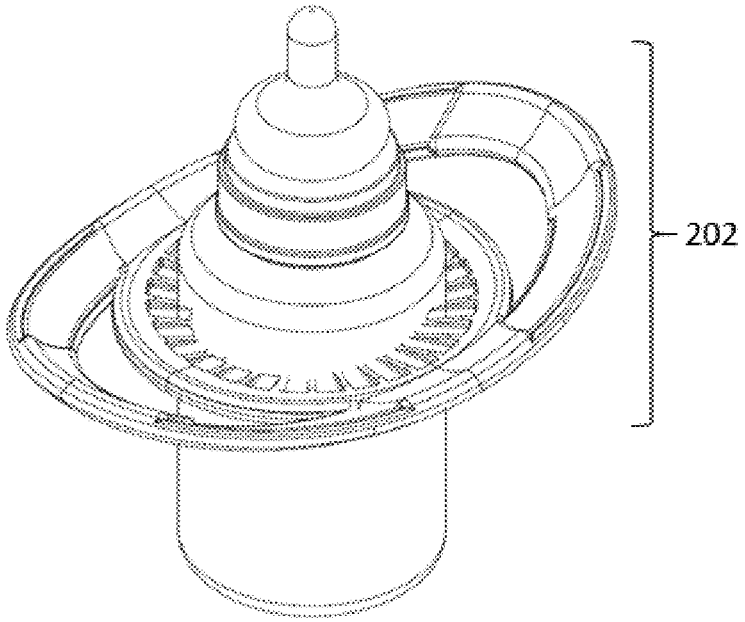
FIG. 15A is a top side isometric view drawing of an embodiment of an oval gripper design variation 1 with bottle inserted.
Figure 15B:
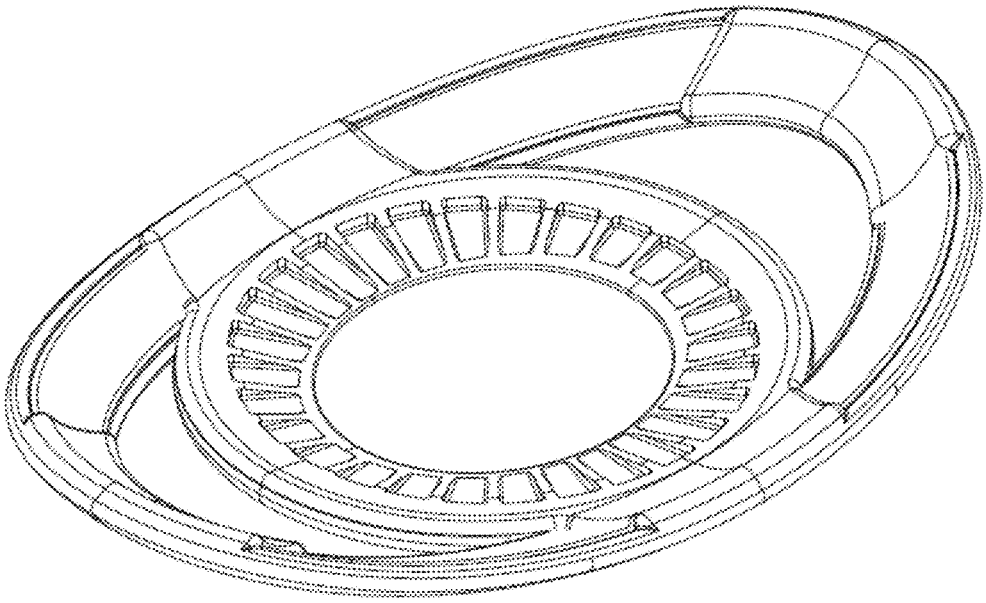
FIG. 15B is an isometric view drawing of the oval gripper design variation 1.
Figure 15C:
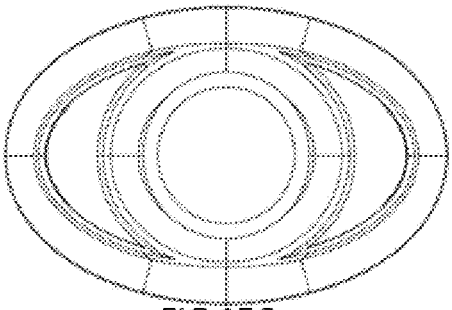
FIG. 15C is a back side top view drawing of the oval gripper design variation 1.
Figure 15D:
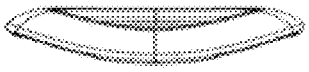
FIG. 15D is a side view drawing of the oval gripper design variation 1 along the short side of the gripper.
Figure 15E:
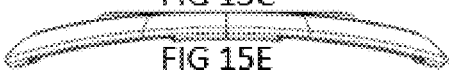
FIG. 15E is a side view drawing of the oval gripper design variation 1 along the long side of the gripper.
Figure 15F:
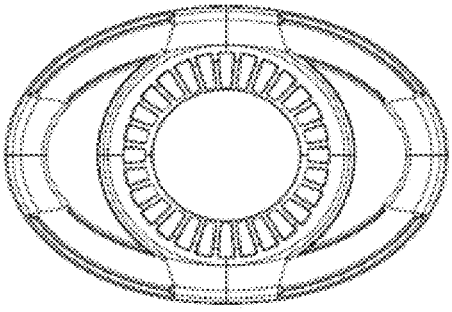
FIG. 15F is a rear side top view drawing of the oval gripper design variation 1.
Figure 16A:
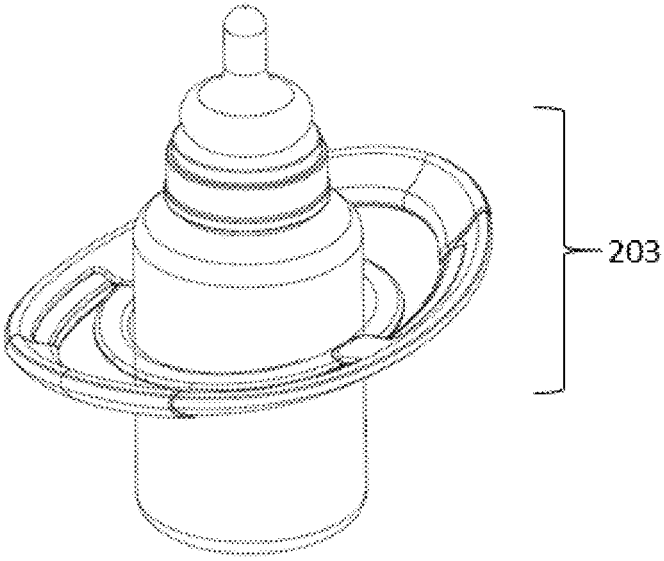
FIG. 16A is a top side isometric view drawing of an embodiment of an oval gripper design variation 2 with bottle inserted.
Figure 16B:
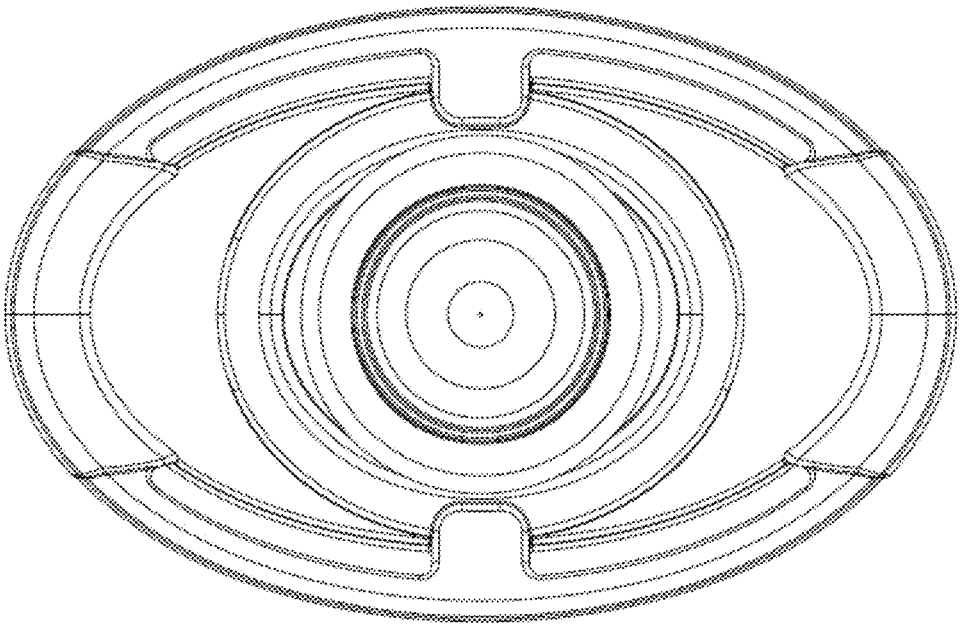
FIG. 16B is a top view drawing of the oval gripper design variation 2 with the bottle inserted.
Figure 16C:
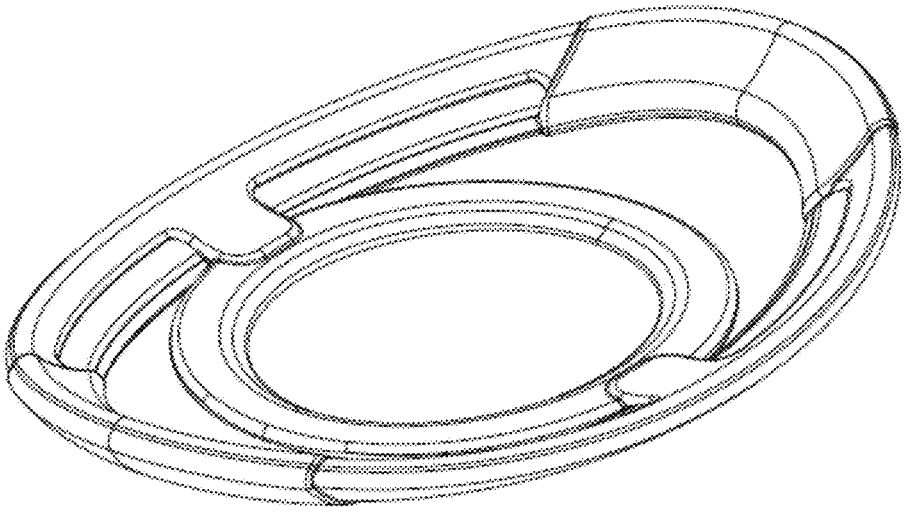
FIG. 16C is an isometric view drawing of the oval gripper design variation 2.
Figure 16D:
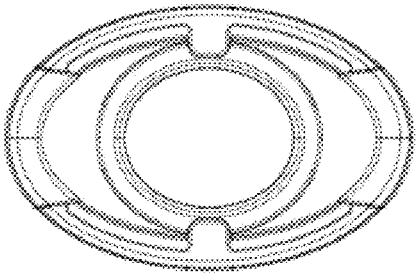
FIG. 16D is a front side top view drawing of the oval gripper design variation 2.
Figure 16F:
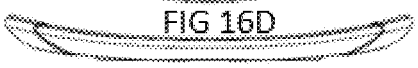
FIG. 16F is a side view drawing of the oval gripper design variation 2 along the long side of the gripper.
Figure 16E:
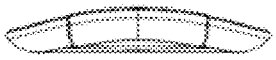
FIG. 16E is a side view drawing of the oval gripper design variation 2 along the short side of the gripper.
Figure 16G:
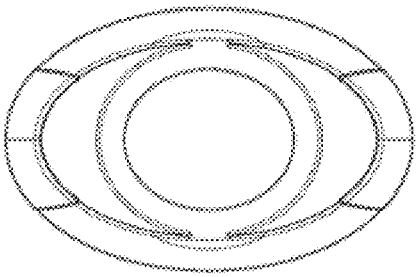
FIG. 16G is a rear side top view drawing of the oval gripper design variation 2.

Embodiment 202 and 203 shown in FIGS. 15A and 16A, resp., display Oval container grip holder concepts are very similar to the Steering Wheel concepts shown in FIGS. 12 & 13 in terms of enclosed and circular bottle gripping area and method of use, however the side handle frames are rounded for a different type of handle grip. Oval design concepts utilize a rubber i.e. TPE stretch/expansion to grab the bottle. Embodiment 202 is very similar to 203 apart from the plurality of slits in the bottle grip area shown in 202.

Figure 17A:
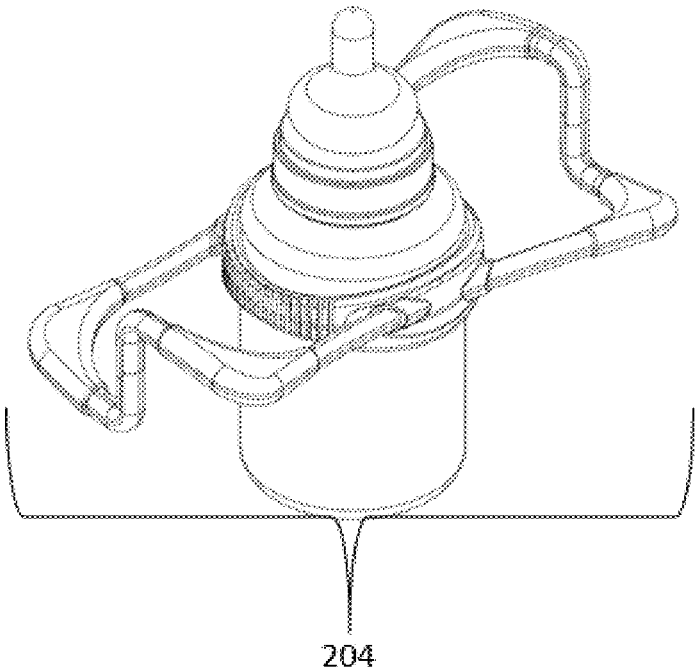
FIG. 17A is a top side isometric view drawing of an embodiment of a twisted frame gripper design variation with bottle inserted.
Figure 17B:
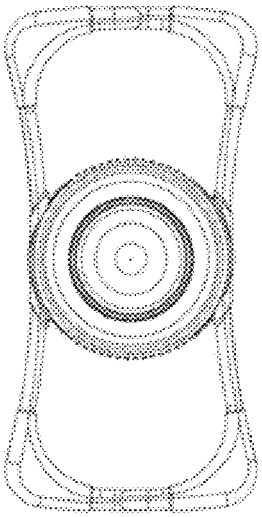
FIG. 17B is a top view drawing of the twisted frame gripper variation with the bottle inserted.
Figure 17C:
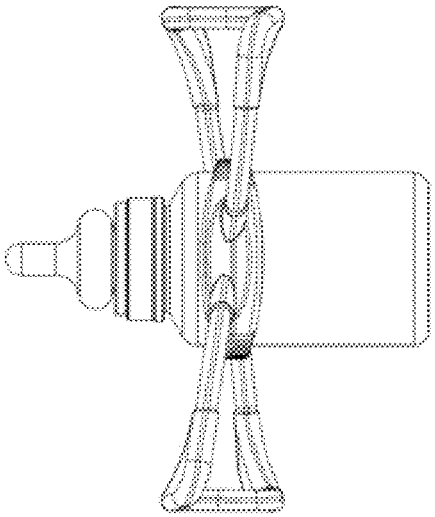
FIG. 17C is a side view drawing of the twisted frame gripper variation with the bottle inserted.
Figure 17D:
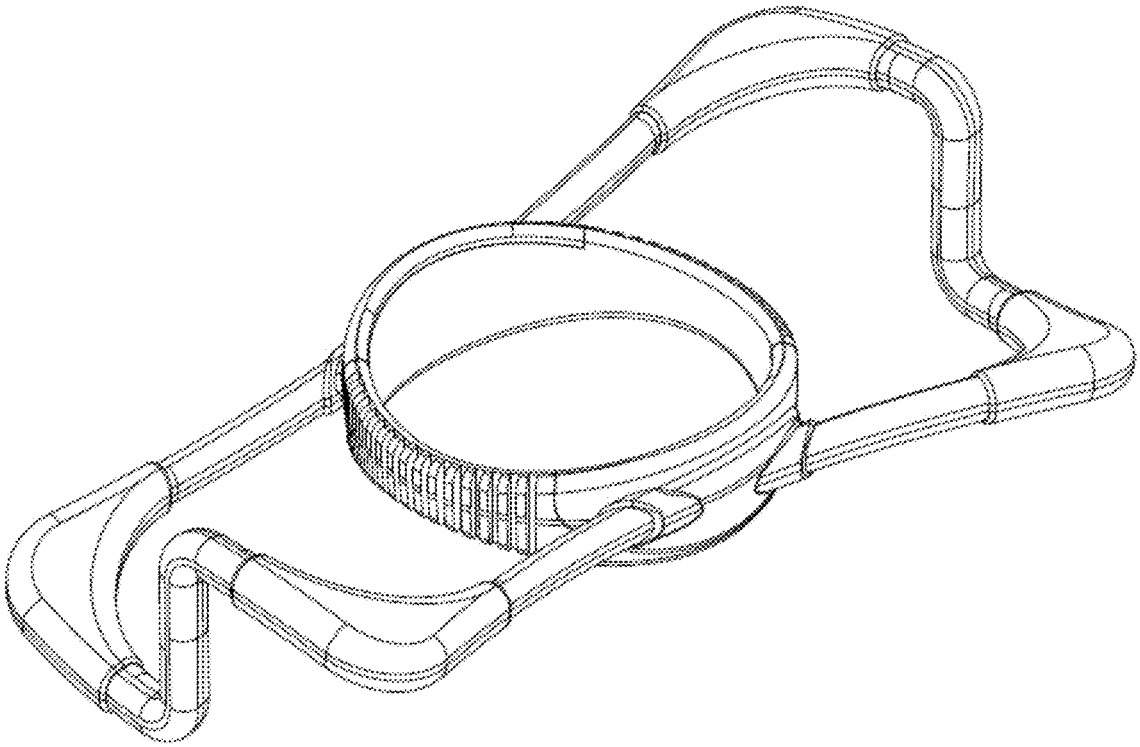
FIG. 17D is a top side isometric view drawing of the twisted frame gripper design variation.
Figure 17E:
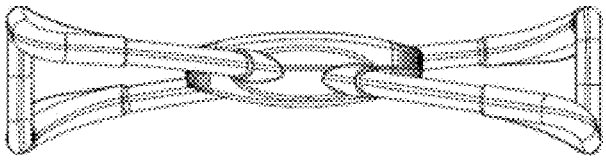
FIG. 17E is a side view drawing of the twisted frame gripper design variation along the long side of the gripper.
Figure 17F:
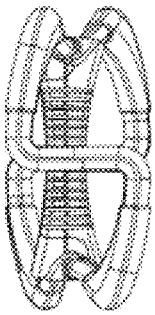
FIG. 17F is a side view drawing of the twisted frame gripper design variation along the short side of the gripper.
Figure 17G:
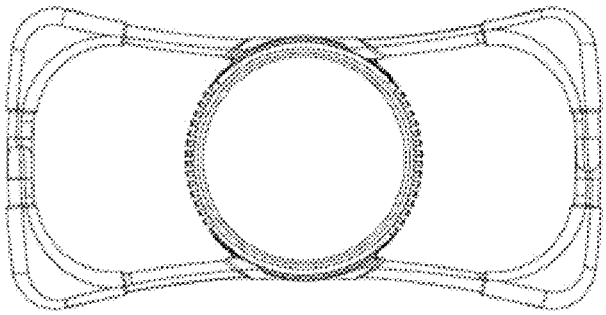
FIG. 17G is a top view drawing of the twisted frame gripper variation.
Figure 18A:
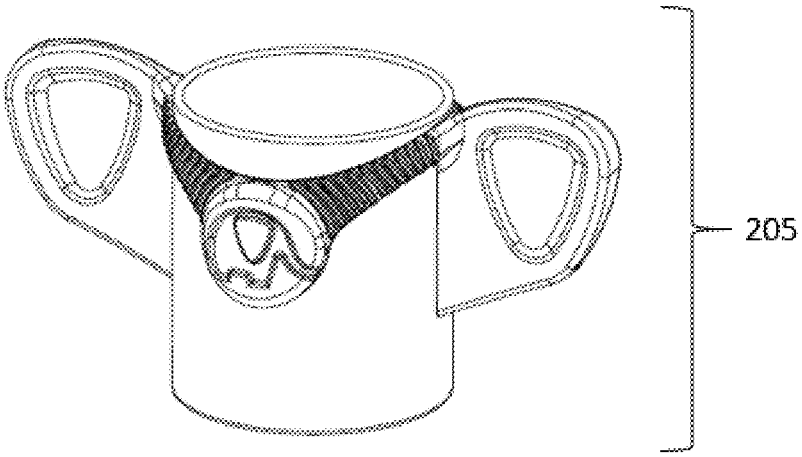
FIG. 18A is a front side isometric drawing of an embodiment of a sleeve/ear gripper design variation.
Figure 18B:
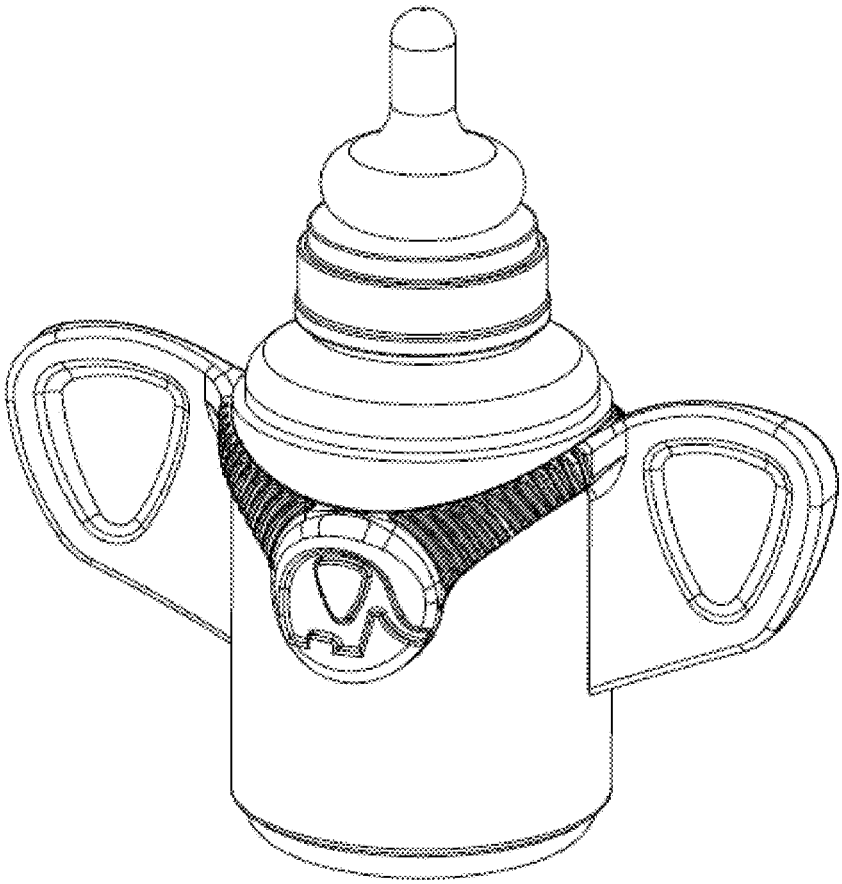
FIG. 18B is a front side isometric drawing of the sleeve/ear gripper design variation with bottle inserted.
Figure 18C:
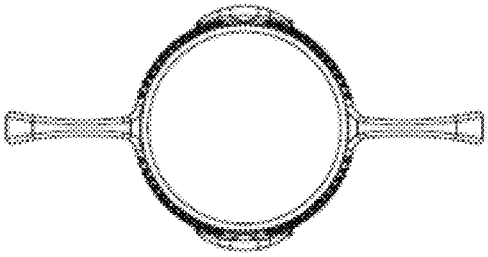
FIG. 18C is a top view drawing of the sleeve/ear gripper design variation.
Figure 18D:
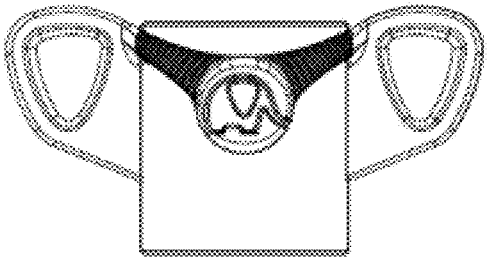
FIG. 18D is a front view drawing of the sleeve/ear gripper design variation.
Figure 18E:
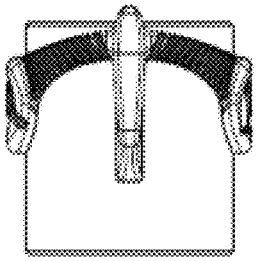
FIG. 18E is a side view drawing of the sleeve/ear gripper design variation.
Figure 19A:
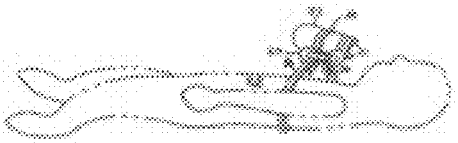
FIG 19A PRIOR ART
FIG. 19A is a side view drawing of a conventional design from U.S. Pat. No. 6,915,991 to Shomer et al for "Bottle retainer for a baby."
Figure 19B:
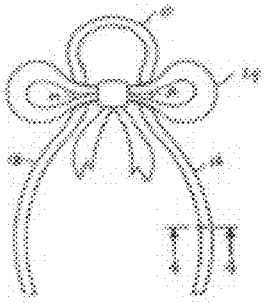
FIG 19B PRIOR ART
FIG. 19B is a front view drawing of a conventional design from U.S. Pat. No. 6,915,991 to Shomer et al for "Bottle retainer for a baby."
Figure 20A:
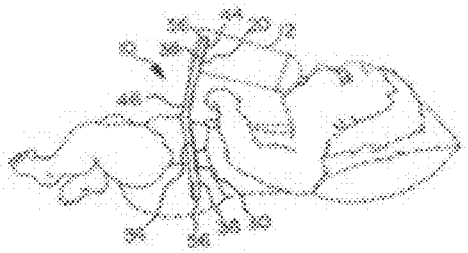
FIG 20A PRIOR ART
FIG. 20A is a side view drawing of a conventional design from U.S. Pat. No. 5,794,898 to Bradley et al for "Nursing bottle propping apparatus.
Figure 20B:
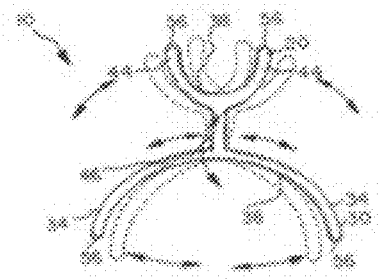
FIG 20B PRIOR ART
FIG. 20B is a front view drawing of a conventional design from the U.S. Pat. No. 5,794,898 to Bradley et al for "Nursing bottle propping apparatus."

Embodiment 204 shown in FIGS. 17A-D show the Twisted container gripper concept that can be adjusted for multiple rectangular configurations. The Twisted container grip concept allows for the baby to grip in multiple places and for the care taker to adjust the position of the container grip depending on preference and ease of use. FIG. 17A is an example of one orientation of the bottle in the Twisted container grip. FIGS. 17B&C is the correctly orientated bottle shown in top and side views of the Twisted container grip. In FIG. 17D, the bottle grip ring has elastic notches (thin and thick areas of material) in the soft rubber so that the ring can stretch over various bottle diameters. FIGS. 17E-G demonstrates the multiple configurations for the Twisted container grip concept.

Embodiment 205 in FIG. 18 is an open sleeve or cup like grip holds for containers, bottles and sippy cups that can slide over the container and the green "ears" can be used as handles for drinking or self-feeding. Embodiment 205 can be composed entirely of a stretchy rubber material or hard plastic or a combination of rubber and plastic so that a container can slide snugly inside the sleeve and the handles can be used to tilt the container when drinking.

Other versions may include one or more of the following embodiments:

Embodiment 1

A beverage container holder, comprising:

a frame having a ring with an aperture configured to support and retain a beverage container, the aperture is configured to adapt to different sizes of beverage containers, appendages extending from the frame, wherein some of the appendages comprise handles and some of the appendages comprise support stabilizers; and the beverage container holder resembles an animal, and the appendages resemble ears and legs of the animal.

Embodiment 2

The beverage container holder of any of these embodiments, wherein the appendages are not identical and comprise matched pairs.

Embodiment 3

The beverage container holder of any of these embodiments, wherein at least a portion of the frame comprises a teether.

Embodiment 4

A beverage container holder, comprising:

a frame comprising a closed hoop that is continuous, the frame has a centrally located, closed ring that is continuous and has an aperture, the aperture is configured to support and retain a beverage container, the aperture is configured to adapt to different sizes of beverage containers, and portions of the frame comprise handles.

Embodiment 5

The beverage container holder of any of these embodiments, wherein the closed hoop and the closed ring are concave in shape.

Embodiment 6

A beverage container holder, comprising:

a frame comprising a closed hoop that is continuous, the frame has centrally located, open grippers that are not continuous, the grippers are configured to support and retain a beverage container, the grippers are configured to adapt to different sizes of beverage containers, and portions of the frame comprise handles.

Embodiment 7

The beverage container holder of any of these embodiments, wherein the closed hoop and the grippers are concave in shape.

Embodiment 8

A beverage container holder, comprising:

a frame comprising a hoop that is closed on a proximal end and open on a distal end, the distal end has grippers that are not connected, the grippers are configured to support and retain a beverage container, the grippers are configured to adapt to different sizes of beverage containers, and portions of the frame comprise handles.

Embodiment 9

The beverage container holder of any of these embodiments, wherein the proximal end is canted at an acute angle relative to the distal end.

Embodiment 10

The beverage container holder of any of these embodiments, wherein the grippers comprise adjoining gripper pairs and a first one of the adjoining gripper pairs does not make contact with a second one of the adjoining gripper pairs.

Embodiments of various systems, method and apparatus for variations in container grip support design concepts that can be used for as a method and apparatus for supporting various drinking containers are disclosed. The foregoing and other objects and advantages of these embodiments will be apparent to those of ordinary skill in the art in view of the following detailed description, taken in conjunction with the appended claims and the accompanying drawings.

The invention claimed is:

1. A beverage container holder, comprising:

a frame having a ring that defines an aperture configured to support and retain a beverage container, the ring including a first plurality of teeth along an inner surface that defines the aperture and a second plurality of teeth along an exterior surface, the first plurality of teeth configured to contact the beverage container, and the aperture is configured to adapt to different sizes of beverage containers;

a first set of appendages extending upward from the ring, wherein the first set of appendages comprise handles that resemble ears of an animal; and a second set of appendages extending downward from the ring and the second set of appendages comprise support stabilizers that resemble legs of an animal.

2. The beverage container holder of claim 1, wherein the first set of appendages are not identical and comprise matched pairs.

3. The beverage container holder of claim 1, wherein at least a portion of the frame comprises a teether.

4. The beverage container holder of claim 1, wherein the ring is concave in shape.

5. The beverage container holder of claim 1, wherein the first set of appendages are concave in shape.

6. The beverage container holder of claim 1, wherein the first set of appendages includes a first appendage and a second appendage, the first appendage does not make contact with the second appendage.

7. The beverage container holder of claim 1, wherein the aperture has diameter between 2.25 inches and 3.3 inches.

8. The beverage container holder of claim 1, wherein each of the first plurality of teeth are wider at a base than at a first side, the base in contact with the ring and the first side opposite the base.

9. The beverage container holder of claim 1, wherein each of the second plurality of teeth are wider at a base than at a first side, the base in contact with the ring and the first side opposite the base.

10. The beverage container holder of claim 1, wherein the first set of appendages are at 95 degrees from center along a x-axis of the frame.

11. The beverage container holder of claim 1, wherein the first set of appendages are at 110 degrees from center along a x-axis of the frame.

12. The beverage container holder of claim 1, wherein the first set of appendages are between 95 and 110 degrees from center along a x axis of the frame.

13. The beverage container holder of claim 1, wherein the beverage container holder is formed from an elastomer.

14. The beverage container holder of claim 1, wherein the beverage container holder is formed from a food safe rubber.

15. A beverage container holder, comprising:

a frame formed from a ring defining an opening, the ring including a first plurality of teeth extending inward into the opening, each of the first plurality of teeth narrowing as each extends from the ring and the each of the first plurality of teeth configured to contact a beverage container position within the opening during use and a second plurality of teeth along an exterior surface of the ring;

a first set of appendages extending upward from an exterior surface of the ring, the first set of appendages to assist a user in holding the beverage container holder during use; and a second set of appendages extending downward from the ring, the second set of appendages to support and stabilize the beverage container holder on a chest of the user during use.

16. The beverage container holder of claim 15, wherein the ring has a diameter of 2.25 inches and the first set of appendages are tilted at 95 degrees from an x-axis of the ring.

17. The beverage container holder of claim 15, wherein the ring has a diameter of 3.3 inches and the first set of appendages are tilted at 110 degrees from an x-axis of the ring.

18. The beverage container holder of claim 15, wherein the second set of appendages are bent outward from the ring.

19. The beverage container holder of claim 15, wherein each of the second plurality of teeth are wider at a base than at a first side, the base in contact with the ring and the first side opposite the base.

20. The beverage container holder of claim 15, wherein the beverage container holder is formed from an elastomer.

21. The beverage container holder of claim 15, wherein the aperture has diameter between 2.25 inches and 3.3 inches.

* * * * *